US006536763B1

(12) United States Patent
Braun

(10) Patent No.: US 6,536,763 B1
(45) Date of Patent: Mar. 25, 2003

(54) GAME PROVIDED IN THE FORM OF A BALL TRACK

(76) Inventor: Wilfried Braun, Konstantinweg 4, Mainz (DE), D-55126

( * ) Notice: Subject to any disclaimer, the term of this patent is extended or adjusted under 35 U.S.C. 154(b) by 0 days.

(21) Appl. No.: 09/890,906

(22) PCT Filed: Dec. 22, 2000

(86) PCT No.: PCT/DE99/04106

§ 371 (c)(1),
(2), (4) Date: Aug. 6, 2001

(87) PCT Pub. No.: WO00/47300

PCT Pub. Date: Aug. 17, 2000

(30) Foreign Application Priority Data

Feb. 13, 1999 (DE) ..... 199 06 117

(51) Int. Cl.[7] ..... A63F 7/36; A63F 7/28; A63F 7/00

(52) U.S. Cl. ..... 273/118 R; 273/123 R; 446/168

(58) Field of Search ..... 273/108, 123 RA, 273/118 RA; 446/168, 170

(56) References Cited

U.S. PATENT DOCUMENTS 1,714,433 A * 5/1929 Molnar ..... 446/168
3,946,516 A * 3/1976 Wirth ..... 446/117
4,175,665 A * 11/1979 Dogliotti ..... 211/59.2
5,312,285 A * 5/1994 Rieber et al. ..... 273/109
5,344,143 A * 9/1994 Yule ..... 273/118 R
5,924,907 A * 7/1999 Tobin ..... 446/118
5,944,575 A * 8/1999 Tolnay ..... 446/128

FOREIGN PATENT DOCUMENTS

DE 25 47 070 4/1977
DE 296 15 318 1/1997

* cited by examiner

*Primary Examiner*—Raleigh W. Chiu
(74) *Attorney, Agent, or Firm*—Michael L. Dunn

(57) ABSTRACT

The invention relates to game which is provided in the form of a ball track and which is comprised of individual components having roller rails. The roller rails have a guide for balls that roll and have at least one through boring for leading into a connecting element arranged below said through boring. The connecting element has a ball passageway which is essentially vertical and/or which is distinctly slanted with regard to the horizontal. In order to provide a ball track which can be variably composed of few different elements (roller rails and connecting elements), whereby a high degree of stability should be attained also in high structures, roller rails and connecting elements can be assembled side by side or one above the other to produce a ball path which leads away over more than one component, whereby the ball path horizontally extends at least on a section of the rolling rail.

56 Claims, 29 Drawing Sheets

49

Figure 1A:
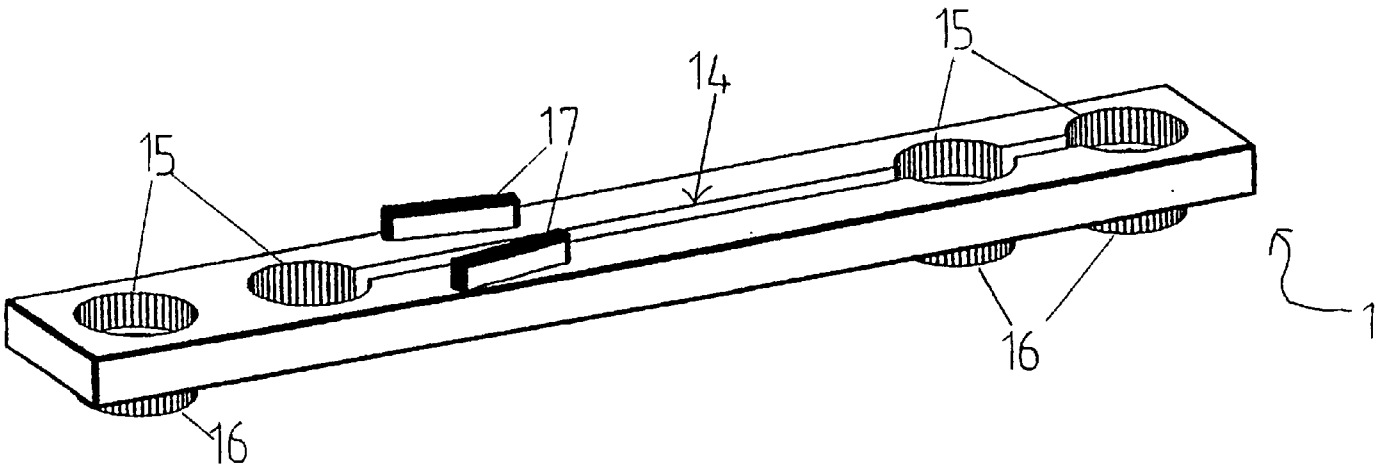

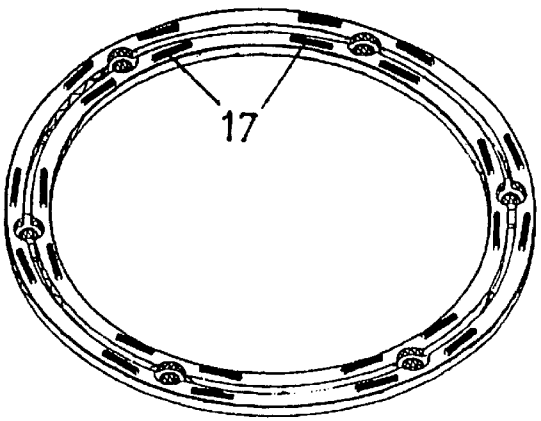
FIG 30b
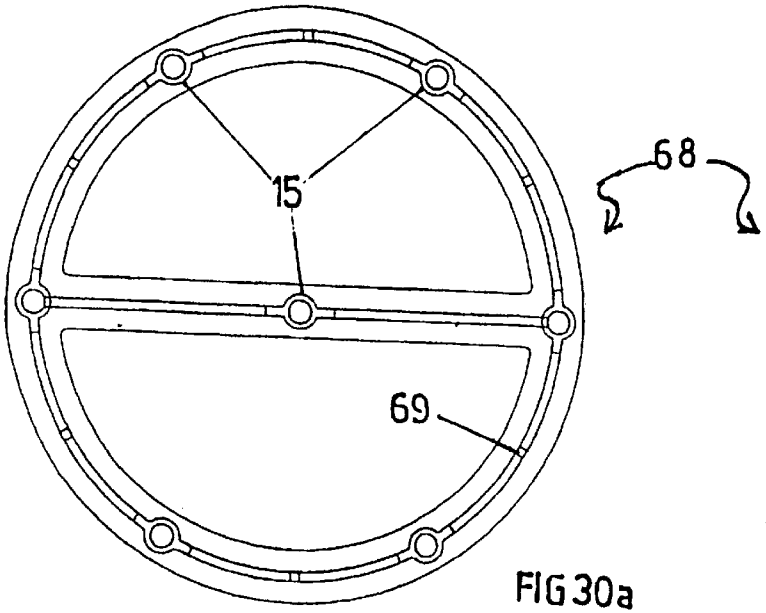
FIG 30a
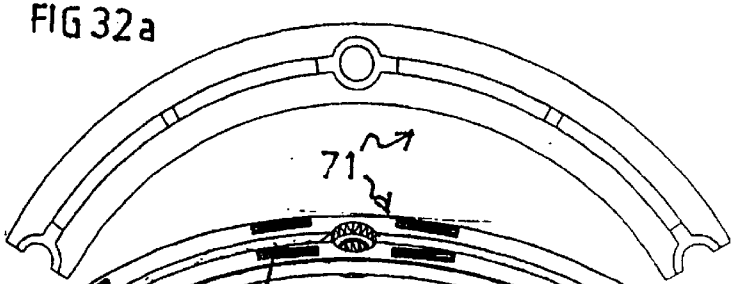
FIG 32a
FIG 32b
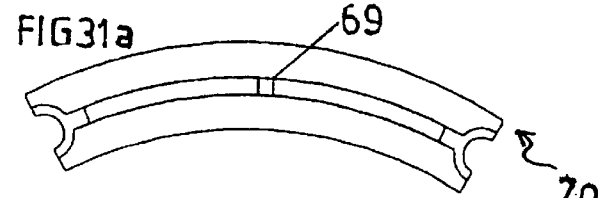
FIG 31a
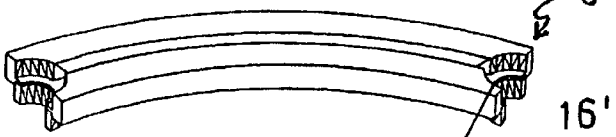
FIG 31b

GAME PROVIDED IN THE FORM OF A BALL TRACK

The present invention relates to a ball track composed of individual components with running tracks that have a guide for rolling balls, and with connecting elements that have a ball passageway substantially vertical and/or distinctly inclined with respect to the horizontal, wherein the running tracks are provided with at least one through aperture or respectively through bore for transferring a ball to another component.

Numerous configurations of ball tracks are known, and commercially available. The great majority of the ball tracks concerned have running tracks that are fixed, and mostly installed one above another. These ball tracks, mostly made in one piece, have the advantage that they can be played with immediately. Because of the fixed, pre-determined paths and as use of the track is limited to using a ball or another suitable object, the ball track user quickly loses interest in it.

The ball track known from utility model patent GM 75 11 147 that forms the prior art on which the present invention is based, has the advantage that the user is given a certain degree of freedom in the layout of the ball track. This ensures that the user's interest in the ball track, in particular the interest of a playing child, is maintained for a greater period of time. The pedagogical value of such variable tracks is far greater, as the imagination and the child's logical and constructive thinking is more strongly promoted in this case.

With this known ball track, the running tracks are inclined in order to accelerate the balls along said running tracks, so the running tracks can only be played with from one direction. Further, this ball track has the disadvantage that no provision is made for assembling several running tracks one above another. Because the tracks are inclined, there is no simple way of building up the connecting elements on top of one another, so when assembled together, in particular in the case of tall constructions, the ball track is unstable.

A ball track with parallel tracks is known from utility model patent application DE 296 15 318. With this fixed construction ball track, the balls go through a bore in the running tracks onto a circular track segment. In this way the balls accelerated by free fall are steered onto the horizontal running tracks below. Because of the single piece configuration, however, no flexibility is possible with respect to the layout.

A variable ball track is also known from GB 2285755. However, in this case running tracks and connecting elements are prefabricated in a single piece. In addition, the running tracks of the assembled components are inclined, so the rolling element components can only travel in a direction pre-determined in the manufacturing process.

The toy building set of DE 25 47 070 is constructed in a comparable manner. In this case, rectangular building blocks with an inclined groove and a gap at the lowest point are arranged on top of one another. In this case also, the direction of travel of the ball is pre-determined because of the pre-fabricated building blocks.

In DE 24 42 904 an attempt is made to increase the variability of the ball track by making running tracks that can be placed or hooked into hollow cylindrical connecting elements. This construction is always unstable, however. In addition, because of the inclined arrangement of the running tracks, reversing the direction of travel on a running track is not possible.

Lastly, German utility patent DE 1 676 519 discloses a variable ball track. Variability is limited, however, to tracks arranged in an inclined manner being placed in connecting elements that are arranged on pillars of different heights, wherein the connecting elements can be rotated about a vertical axis with respect to the pillars.

Compared to fixed ball tracks, this simply has the advantage that individual running tracks can be rotated out of the plane of the ball track.

The object of the present invention is therefore to provide a ball track that can be assembled in a variable manner from a few different elements (running tracks and connecting elements), wherein a high degree of stability is obtained even with tall constructions.

This object is solved in that the running tracks and connecting elements can be attached to and detached from one another in order to create a ball path that goes beyond more than one component, wherein the ball path runs horizontally on at least one section of the tracks.

A ball path is understood to be the course that a ball takes when it rolls along the components.

The horizontal running track sections allow stable connection to the connecting elements without affecting variability. In this way the ball track cannot be toppled easily when accidentally knocked or when being dismantled, even with tall constructions, that is to say constructions with many running track sections at different heights.

Running tracks are particularly preferred that create a ball path that runs horizontally over the entire length of the running tracks. As the running tracks or respectively the ball path on the running tracks does not have a pre-determined incline, it is possible for the ball to travel in both directions on the running tracks. The variability of the ball track is significantly increased. On the one hand, when assembling construction of the ball path it is unnecessary to already establish the direction of travel. A ball track can also be constructed that can sometimes be travelled on in one and sometimes in the other direction, irrespective of the ball's starting point.

In principle, such a ball track also allows the connection of connecting elements or running tracks to one another. A construction made exclusively of connecting elements is thus possible.

The variability of this ball track can be increased significantly further when running tracks and connecting elements can be connected to one another in a rotatable manner about a substantially vertical axis.

Within certain limits, constructions on an oblique plane are also possible, where the axis of rotation is somewhat tipped over from the vertical. The limits of permissible inclination of the substantially horizontal running tracks are established in that the ball track must remain playable, that is to say a ball must travel along the running tracks to the pre-determined point where it again falls through a through bore in order to be accelerated again by gravity when the ball subsequently passes through a connecting element.

Preferably, the connecting elements are substantially in the shape of pillars or blocks and are provided with vertical through bores or respectively bore sections.

It can be advantageous to equip with connecting element with a sound producing apparatus that generates a sound when a ball passes through the connecting element. The sound producing apparatus can be, for example, a bell that is struck by the ball. It is particularly advantageous, however, in particular when the connecting elements are made of wood, to provide a resonant volume through which the ball rolls, so when the ball hits, for example, a wall, a sound is produced. It is then also possible to create different sounds in different connecting elements. Whole melodies can be put together by means of the ball path.

It is further advantageous that in at least some of the connecting elements at least one side exit aperture is provided, and that at least one section of the bore within the connecting element has a degree of inclination with respect to the horizontal of between 0° and 90°, so a ball that falls into the upper bore of the connecting element undergoes acceleration with horizontal components when passing through the bore.

In this way it is possible to use substantially planar running tracks even for longer ball paths. Because of the friction, which is not negligible, between the ball and running tracks, on horizontal running tracks the ball loses speed. In order to provide longer ball paths, the ball must be accelerated again in the meantime. The ball gains the necessary speed in passing through the vertical as well as the inclined or respectively curved bores in the connecting elements. In this way, it is ensured that the (horizontal) running tracks can in principle be travelled along from both sides.

The ball path can be configured in a more interesting way in that at least some of the connecting elements have two side exit apertures, that are formed by branching of the vertical bore section. In this way it is possible to continue the ball path in at least two directions from such a connecting element. The decision as to which side exit aperture the ball entering the connecting element takes can either be left to chance or manually or remotely influenced by means of a suitable device, according to the configuration. It is also possible to use an apparatus that has a type of tipping mechanism that is activated by balls passing through so that the balls alternatively take one or the other side exit aperture.

Preferably, the side exit apertures are arranged at least high enough that two running tracks can be laid over one another and a ball leaving one of the side exit apertures is diverted to the upper running track.

A further increase in variability is possible in that at least some of the connecting elements have a passage running horizontally in their lower area. In this way it is possible for a ball to pass through or respectively fall through two or more connecting elements one directly after another.

In an advantageous configuration of the ball track, some of the connecting elements have different effective heights that correspond to a whole number multiple of a predetermined modular dimension, that is preferably determined by the (vertical) thickness of the running tracks. In this way it is very easy, in particular for small children, to ensure that when assembling the ball track the running tracks sit horizontally on the connecting elements.

The variability of the ball track can be increased yet further when at least some of the running tracks each have at least three through bores. By means of additional through bores, one and the same running track can be used for very different ball paths. The additional bores can either be used for constructing a further plane in which a further running track is provided or as a connecting path to another plane that is reached in a direct path via one or more connecting elements or via a longer path in free fall. Naturally, two different ball paths can be combined on one running track. If, for example, different ball paths respectively at different ends of the running track meet on said running track, the two ball paths are united at the bore facing towards the centre of the running tracks.

In order for a running track for a ball track to be useable over as full a length as possible, it is advantageous for at least some of the running tracks to have two bores on at least one end section. In this way the bore located at the end of the running track can be used for constructing another, additional, ball path, without significantly shortening the running length of the ball path using the first running channel.

The variability of the ball track is further increased in that at least some of the running tracks have the through bores respectively arranged close together on both end sections. The short distance apart, however, should be at least large enough so that two connecting elements can be placed next to one another on the closely adjacent through bores.

In order to increase the variability of the ball track, it can be advantageous for some of the tracks to have one through bore or respectively even two through bores arranged approximately centrally according to the length of said tracks.

In addition, a bridging element can be provided that can be placed on a (any) through bore in order to close it. Thus, through bores that prove unnecessary or even annoying during the construction phase, can be closed. More advantageously, the bridging element has on at least one side a guide for the balls, so the travel of the balls interrupted by the through bore can be expanded by means of the bridging element. In order that the guide cannot be twisted accidentally in relation to the running tracks, it is useful to have a guide nose on the bridging element, which guide nose engages with the running track and prevents twisting of the bridging element.

In an advantageous configuration, the ball guides in the tracks are formed by a continuous slot, preferably running along a central longitudinal line of the tracks. This configuration has the advantage that it can be implemented very inexpensively. The width of the slot affects the speed of the balls, and conversely also the stability of the rolling procedure.

By matching the incline of the side exit apertures of some of the connecting elements to the width of the slot, the running speed can be adjusted almost infinitely. Preferably, a slow running speed and thereby a long running time for the balls is implemented. In this way, particularly with long ball paths, it is possible to visually follow the balls.

Alternatively, the ball guides can also be formed by a channel cut or respectively moulded into the upper side of the tracks.

A further increase in stability can be obtained in that projections and cut-outs are provided on the running tracks and on the connecting elements which when the running tracks and connecting elements are in the assembled state, alternately engage with one another, so the assembled tracks and connecting elements are protected from relative sideways movements.

Consequently, despite almost infinite variability, a very stable construction is possible.

The projections and cut-outs are preferably arranged concentrically to the vertical through bores and respectively bore sections of track and connecting element. This arrangement makes it possible for a running track lying on a connecting element to be brought into a position rotated about the vertical axis of the connecting element without the connecting element and the construction located below it having to be disturbed.

In a preferred configuration, the projections and cut-outs are configured or arranged in a circular or respectively annular manner so that tracks and connecting elements assembled together are rotatable relative to one another about the common circle axis of projections and cut-outs as desired or in fixed angles. In this way it is possible for individual running tracks within the assembled construction to be rotated about the vertical axis of the connecting element connected thereto, without endangering the stability of the whole construction.

A further improvement is possible in that the connecting elements have an annular cut-out in their upper side, surrounding the upper aperture, and on their underside a cylindrical or hollow cylindrical projection coaxial thereto, the outside diameter of which is smaller than or equal to the diameter of the upper aperture of the through bores of the tracks, wherein this in turn preferably corresponds to the internal diameter of the cut-out arranged above. Because of these stable connecting elements, the blocks can be stacked interchangeably. Moreover, the cylindrical or hollow cylindrical projection of the connecting element can be latched into the through bore of the tracks. This also produces a very stable, rotatable connection.

The stability of the ball track can be further increased in that the running tracks are provided on their underside, in the case of at least some through bores, with an annular projection arranged concentrically to said bore, the outside diameter of said projection being equal to the inside diameter of the annular projection of the connecting elements. This ensures that the annular projection on the underside of the running tracks can be placed so that it fits into the annular cut-out on the upper side of the connecting elements.

In a preferred configuration of the ball track, connecting plates are provided that are provided with one or more through bores, the size of which, including any projections provided on the lower end of the bore, corresponds to the dimensions of the through bore of the running track. The connecting plates can be used for constructing and connecting stepped arrangements of the connecting elements within an overall construction or within a tower construction of connecting elements only.

Advantageously, the connecting plates are provided with an effective height that corresponds to a whole-number multiple of the modular dimension or respectively of the (vertical) thickness of the running tracks. In this way it is ensured that when assembling the ball track, horizontal arrangement of the running tracks can be obtained easily.

In a preferred configuration of the ball track, in addition to the substantially horizontal running tracks, at least one running track is provided whose end sections, running horizontally and provided with through bores or respectively connecting bores, are connecting by means of an inclined rolling path section, the length and incline of which are dimensioned such that the difference in level between horizontal end sections corresponds to a whole number multiple of the modular dimension determined by the running track thickness. In this way additional inclined running tracks that are in turn firmly connected by their horizontal end sections and the secure projection and cut-out engagement made there, can be incorporated into the construction without the stability of the overall construction being endangered. Because of the difference in level being matched to the given modular dimension it is ensured that, starting with constructions of these connecting tracks, it is possible to again alter a horizontal arrangement of the running tracks or respectively running track sections, without tracks configured as an inclined path section.

In order to be able to play on the ball track with several balls at the same time, it is advantageous that on the upper side of the connecting tracks at least one pair of guides is fixed on both sides of the running channel, the end of the guide facing towards the through bore of the running tracks being somewhat further away from the channel than the other end of the guide. The balls, in certain circumstances exiting in large quantities in rapid succession, or even at the same time from the side aperture of the connecting element possibly hit one another, jump and are then guides back onto the running channel by the guides. In particular when using a large number of balls, without guides it is possible for two or more balls to hit one another, jump and leave the running track from the side.

A further increase in versatility of the present invention can be obtained by means of a sorting element. The sorting element has a passage that is smaller than the through apertures in running tracks and connecting elements. If the ball track is played using balls of different sizes, some of the balls can pass through the passage in the sorting element while others are prevented from doing so.

Such a sorting element can, for example, be a running track with a smaller through aperture. If such a running track is built into the ball path, the smaller diameter balls fall through the smaller through aperture, while the larger diameter balls run (almost unobstructed) further along the running tracks.

Naturally, such a sorting element can also be implemented using a connecting element or bridging element.

A further increase in the versatility of the ball track can be obtained in that a tipping element is provided that can be positioned on the running tracks and/or the connecting elements, and that has a receiving means with a receiving position and a release position, wherein in the receiving position, the receiving position is able to receive at least one rolling element, and in the release position, is able to release at least one rolling element.

A configuration is also particularly advantageous in which in the receiving position the receiving means assumes a stable balance that becomes unstable on receiving one or more rolling elements, so that the receiving means transfers to the release position. This tipping element is incorporated into the ball path such that the balls fall or roll into the receiving means of the tipping element while the receiving means is in the receiving position. The tipping element is constructed such that when the receiving means has a certain number of balls received, it automatically goes into the release position, and releases at least some of the balls received. Automatic transfer into the release position can take place, for example, by the receiving position becoming unstable at some point because of the weight of the balls, so that the receiving means automatically transfers to the release position that has become stable due to the weight of the balls. After at least some of the balls have been released again onto the running track, the release position become unstable again, and the receiving means returns again to the receiving position that has once again become stable.

The tipping element described can be further improved in that the tipping element is provided with two receiving elements, wherein a first state of the tipping element, the first receiving means is in the receiving position, and the second is in the release position, and in a second state of the tipping element, the first receiving means is in the release position and the second receiving means is in the receiving position. With this configuration of the tipping element, the balls received are released in two different directions. In this case, the tipping element has two balancing points. At the start, the tipping element assumes any position. The balls are then guided into the receiving means that is in the receiving position. As soon as this receiving means has received a certain number (or a certain weight) of balls, the receiving position of this receiving means becomes unstable, and it transfers to the release position. At the same time, the second receiving means that was initially in the release position is brought into the receiving position. The first receiving means releases the balls received and the second receiving means now receives the balls arriving now until it too has received a certain number of balls. The two receiving means then again exchange roles.

Clearly, the two receiving means can be provided such that they can receive a different number of balls before they go into the release position. It is thus possible by means of such a tipping element, for example, to alternately steer two balls in one direction and to steer one ball in the other direction.

The tipping element can, moreover be combined, for example, with the sorting element. In this case, the tipping element can be provided with a passage between the first and second receiving means that is passable only for small balls. The balls are then steered in one direction until a larger ball obstructs the passage, and the balls following it cause the toppling of the tipping element.

Another configuration of the tipping element with two receiving means provides that there is a moveable separating device, for example, in the form of a moveable flap, that separates the two receiving devices from one another. By means of the mobility of the separating device, the receiving capacity of one receiving means can be increased at the expense of the receiving capacity of the other receiving means. If a ball thus falls into one receiving means, the separating device can move purely because of the weight thereof and thus increase the receiving capacity of that one receiving means. In this way it is ensured that with a tipping element of the same size, significantly more balls can be received in the receiving means before the receiving means goes to the release position. Alternatively to this, it is equally possible to configure the separating means such that it cannot be moved solely by means of the weight of the balls, but instead, for example, can be adjusted manually. The tipping element can be simply adjusted to individual requirements. For example, the separating element can be adjusted such that one receiving device receives just one ball before it goes into the release position, while the other receiving device goes into the release position only when at least three balls are located in it.

A further increase in variability is possible in that a spiral element is provided that guides the balls on a spiral path, that advantageously runs along a conical surface.

Such an element also increases the visual attractiveness of the ball track. It therefore stimulates greater interest, and the player is occupied for longer with this pedagogically valuable toy.

A particularly advantageous configuration of the spiral element provides that the height of the cone that is circumscribed by the spiral path corresponds to a whole number multiple of the modular dimension. In this way the spiral element can be integrated easily into the ball track.

For some instances of application, it can be advantageous when the spiral element can assume at least two positions, wherein in a storage position, the spiral path has substantially no vertical components, and in a playing position the spiral path runs along a conical surface. In this way, in the storage position the spiral element takes up only a small amount of space. If the spiral element is to be used for constructing the ball track, it has to be brought from the storage position into the playing position. The spiral element is thus, for example, extended telescopically until the playing position is obtained.

A further increase in variability is possible in that the spiral element has two or more playing positions that differ by a different height in the cone described by the spiral path, that each preferably amount to a whole number multiple of the modular dimension. According to requirements, the speed of the balls can be altered using such a spiral element. Because the height of the cone circumscribed by the spiral path is adjustable, the slope of the ball path on the spiral element and thus the speed of the balls can be altered.

A spiral element particularly easy to implement provides that the balls on the spiral path gain acceleration by means of the spiral element, that substantially has only a radially inwardly directed component that is exerted on the ball by means of a guide defining the outside of the spiral path of movement of the ball (as reaction force to a centrifugal force). A configuration in which the cone around which the spiral path is wound tapers downwards then often requires no additional guiding elements for the balls. In addition it is ensured by such a configuration that the balls cannot leave the spiral element outwards in the radial direction. Thus, for example, a ball can also be manually thrown (if possible in the correct direction) into the spiral element. Alternatively to this, the ball can also fall into the spiral element by arriving via a running track. Because of the reliable guiding of the balls by the outside of the spiral path, such a spiral element can be played with almost infinitely.

A further configuration of the spiral element has a substantially horizontal straight running track section and a spiral section. The spiral element, instead of a running track inclusive of the subsequent connecting element, can then be integrated into a ball track. The spiral element then preferably additionally has a horizontal section in the centre of the spiral element that makes connection to a next connecting element or to a next running track reliably possible.

A configuration is particularly preferred in which the spiral element is arranged so that it can be played with from both sides. In this case, the spiral path of the spiral element can describe both a downward tapering cone and an upward tapering cone.

A further increase in variability can be obtained with a blocking element with a closable blocking device. This blocking element, which clearly can also be used in other ball tracks, is able to stop the balls during their travel. By opening the blocking device, the balls can then continue their travel. Advantageously, the blocking device has an opening mechanism that can be triggered by a rolling ball. This is, for example, possible by means of a type of clapper that projects into the ball course of an adjacent running track. If a ball now rolls along the adjacent running track, the opening mechanism triggers, and the stopped balls continue on their ball path. The adjacent running track can run both sideways and above or below the blocking element. Advantageously, the opening mechanism is arranged, however, such that it is triggered by a ball running beneath the blocking element.

Particularly preferably, the blocking mechanism of the blocking device is constructed such that when the mechanism is triggered, the blocking device opens and lets just one ball pass. The ball path is, as previously, blocked to all further balls until a further ball triggers the mechanism and again releases just one ball.

Clearly, it is also possible to implement the sorting element, the tipping element, the blocking element or the spiral element individually or in any combination together in other ball tracks. Thus, for example, the spiral element can also be integrated into a fixed ball track as described in the introduction.

It is also clear that the running tracks do not necessarily have to run in a linear manner. For example, curved or circular running tracks or running tracks that follow a segment of a circle, can also be advantageously implemented. The variability of the running tracks can be further increased when the circle segment running tracks cover a circumference angle that is a multiple of a given modular angle. This modular angle should advantageously be a divisor of 360°. Thus, advantageously, 60° and 120° circle segment running tracks are then used.

The variability of the ball track can be yet further increased in that at least some of the running tracks are forked, so that the ball path branches. The choice as to which ball path will be taken can either be left to chance or determined manually with the aid of a diverting element.

Figure 2A:
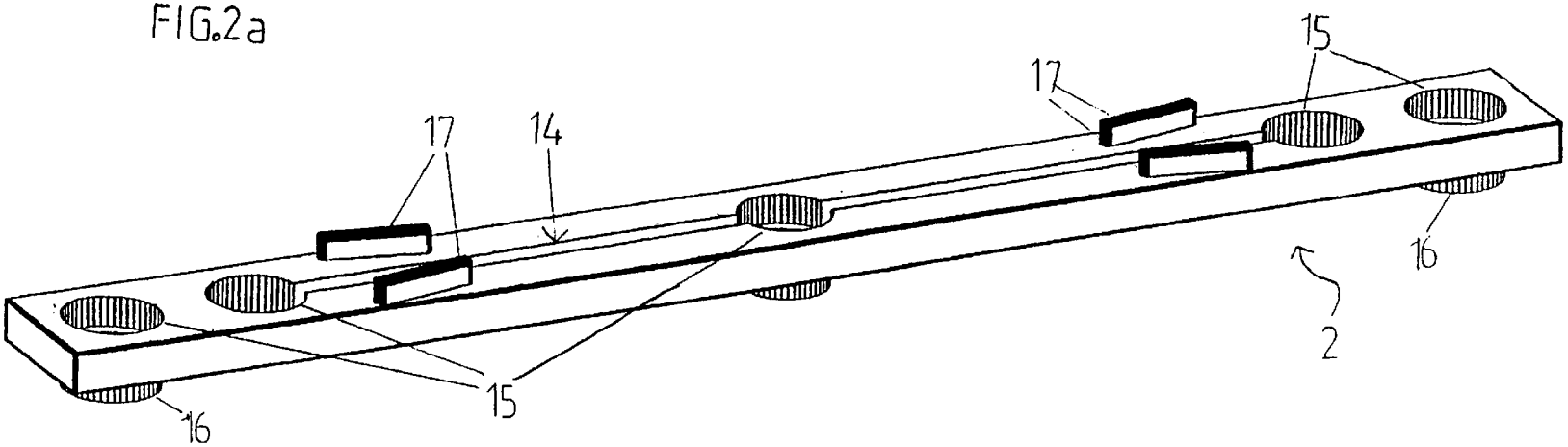
Figure 3A:
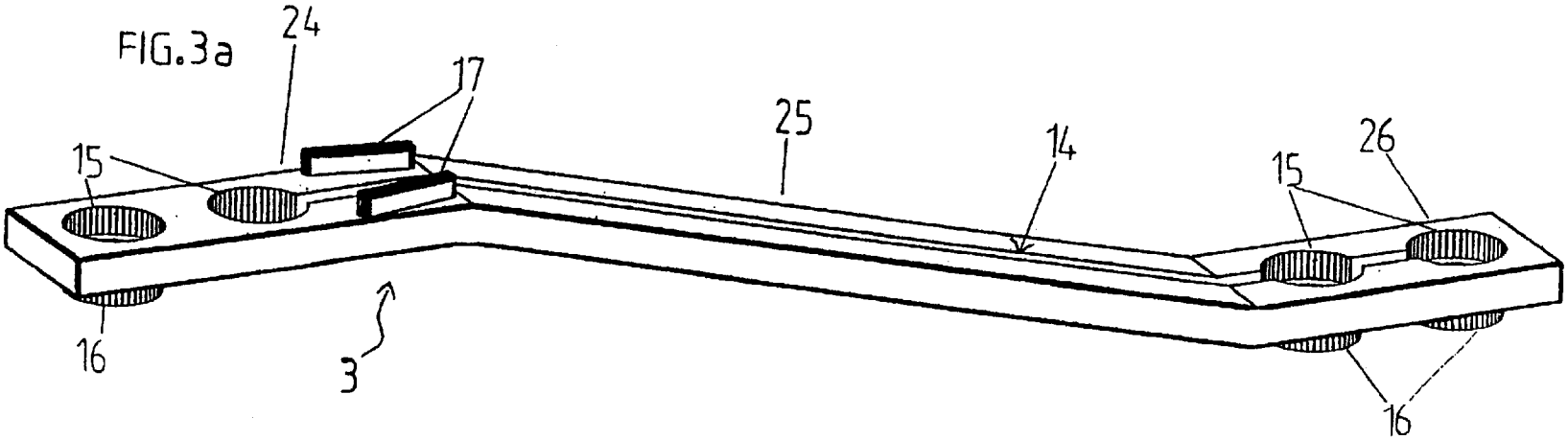
Figure 4A:
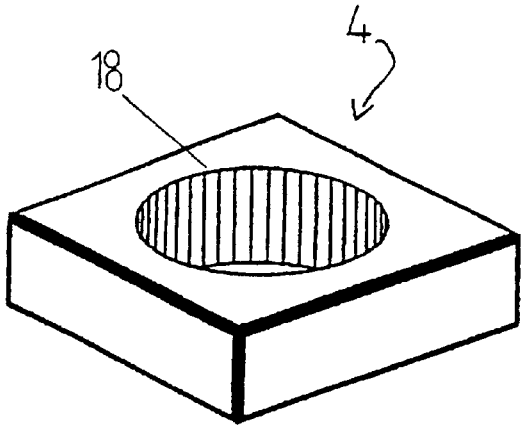
Figure 5A:
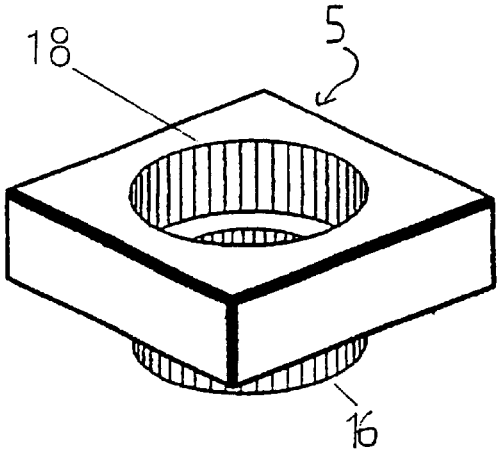
Figure 6A:
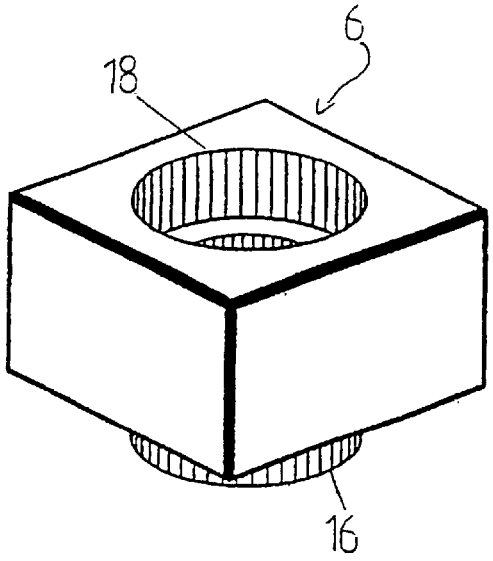
Figure 7A:
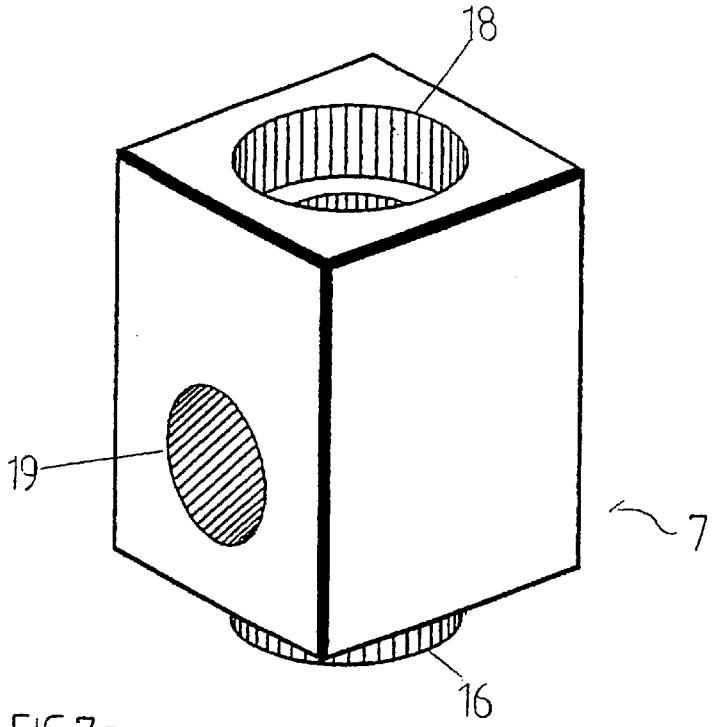
Figure 8A:
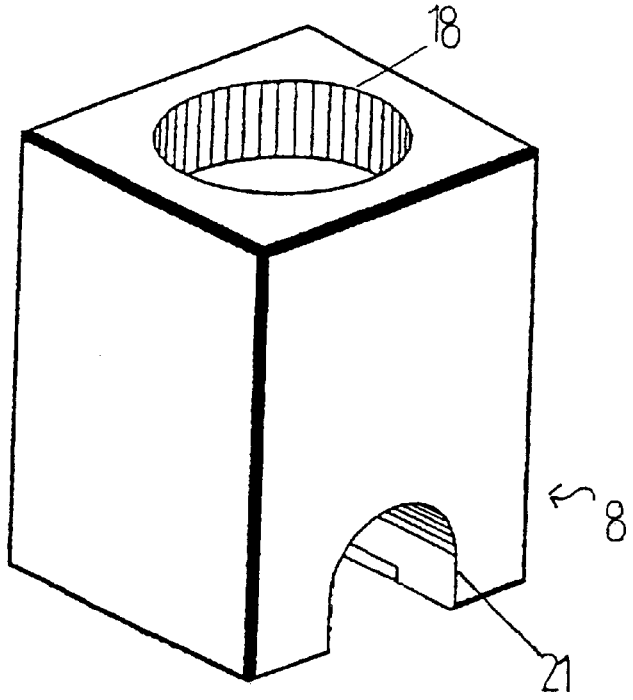
Figure 9A:
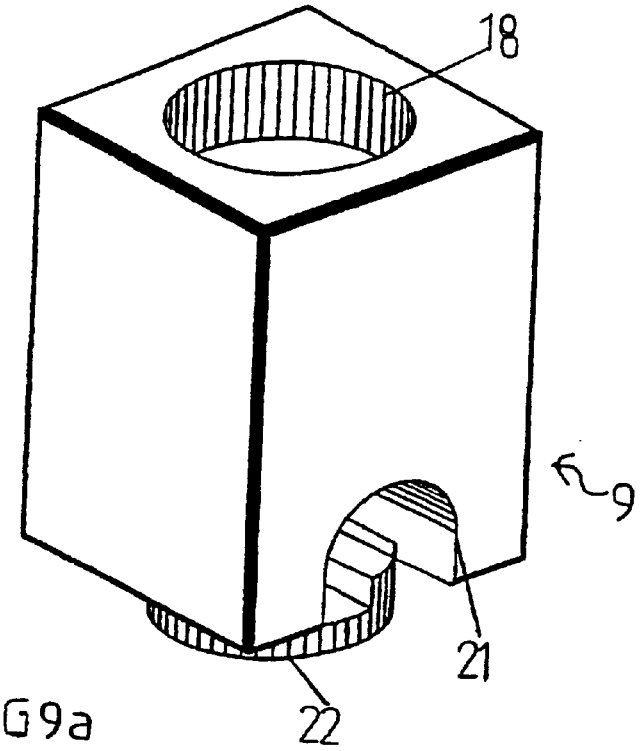
Figure 10A:
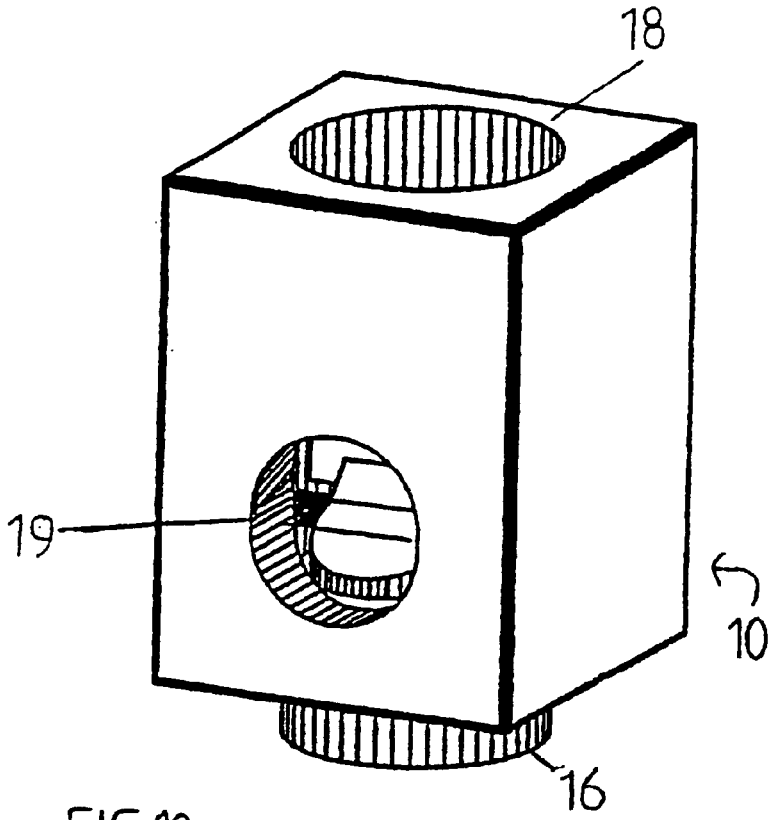
Figure 11A:
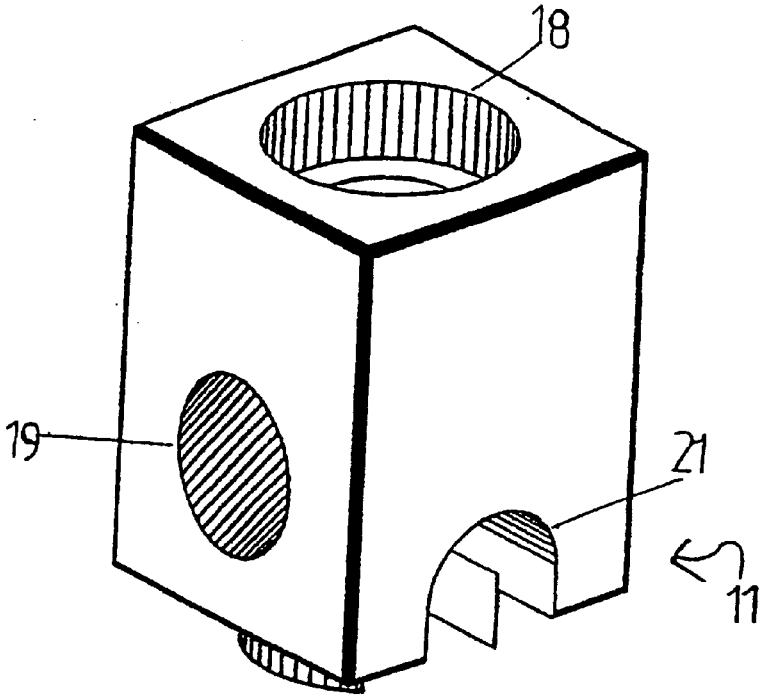
Figure 11B:
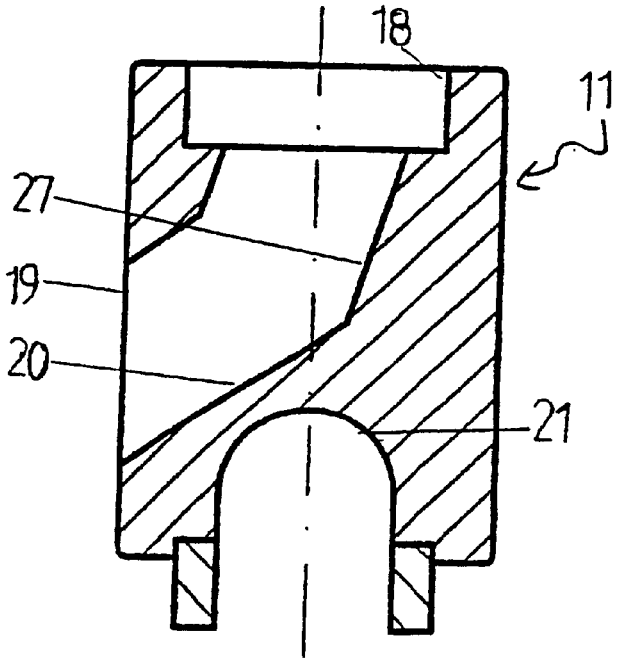
Figure 12A:
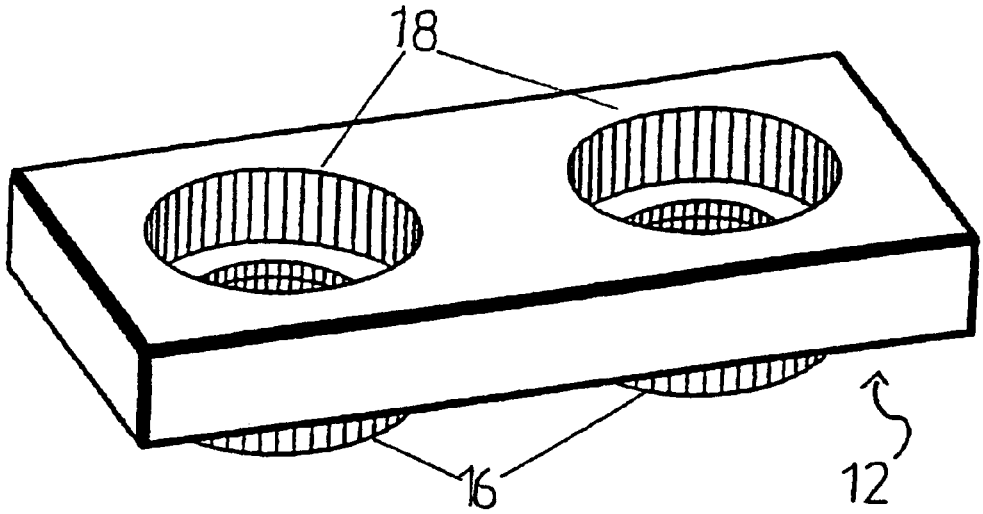
Figure 13A:
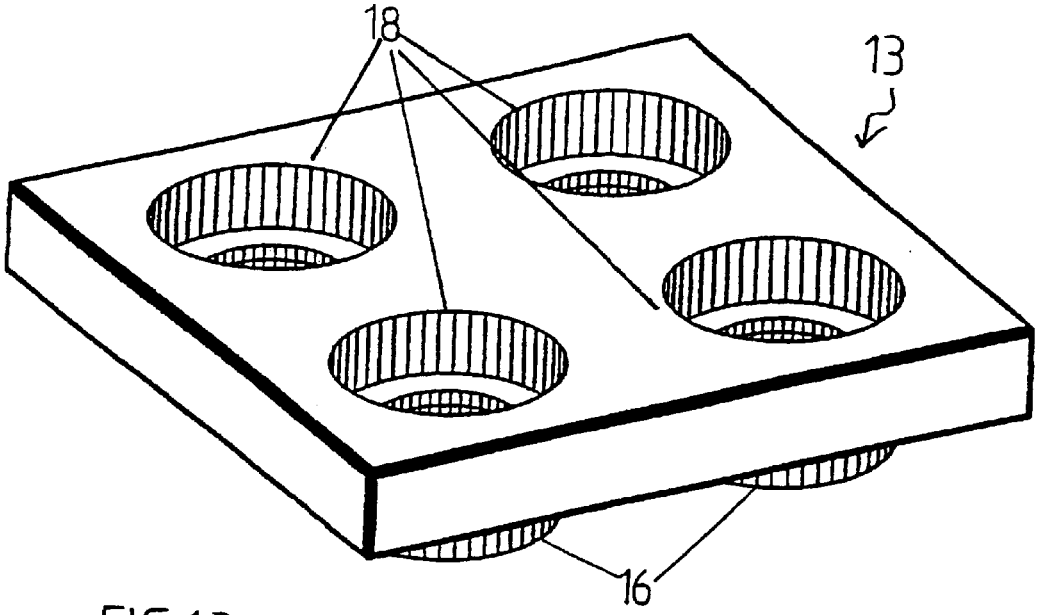
Figure 14:
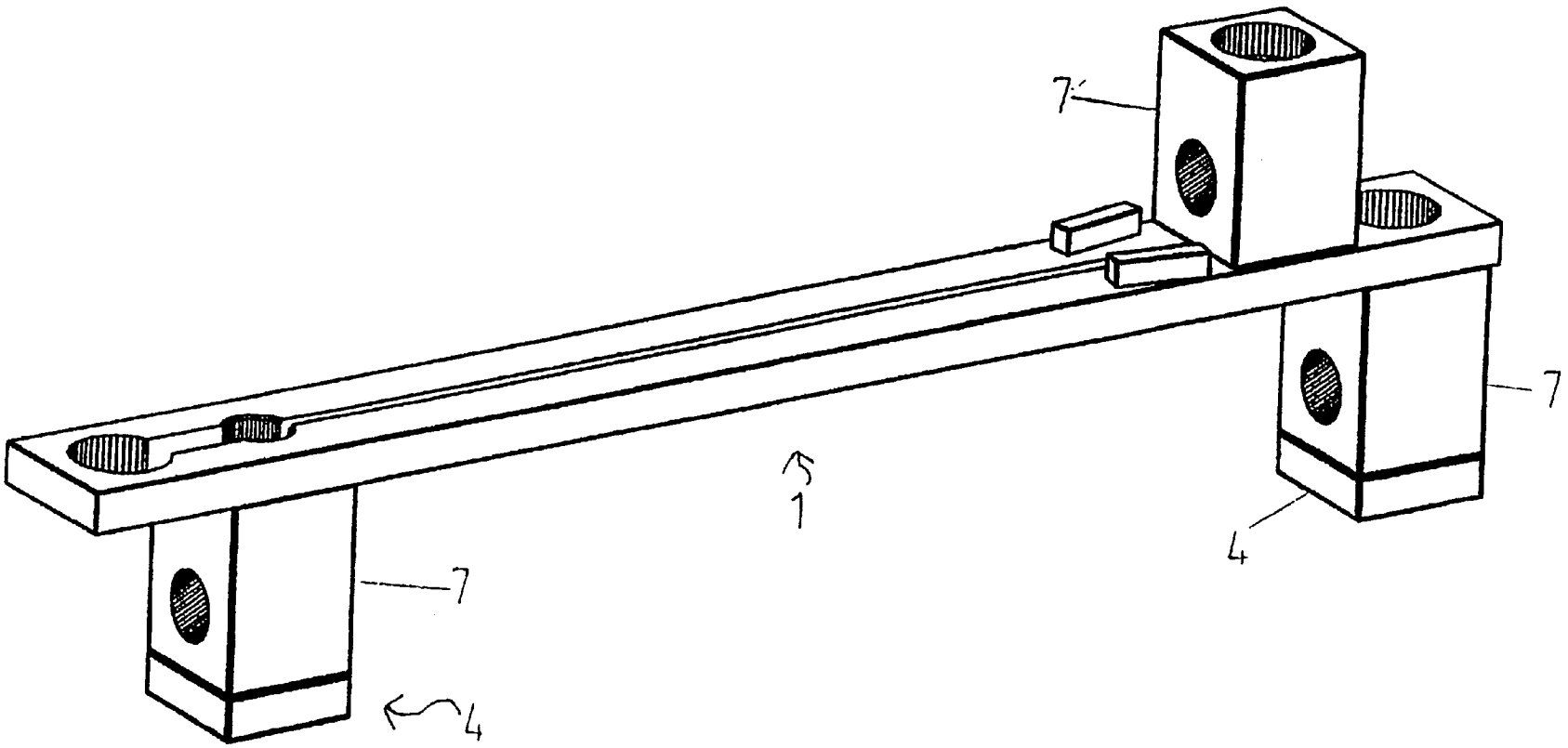
Figure 15:
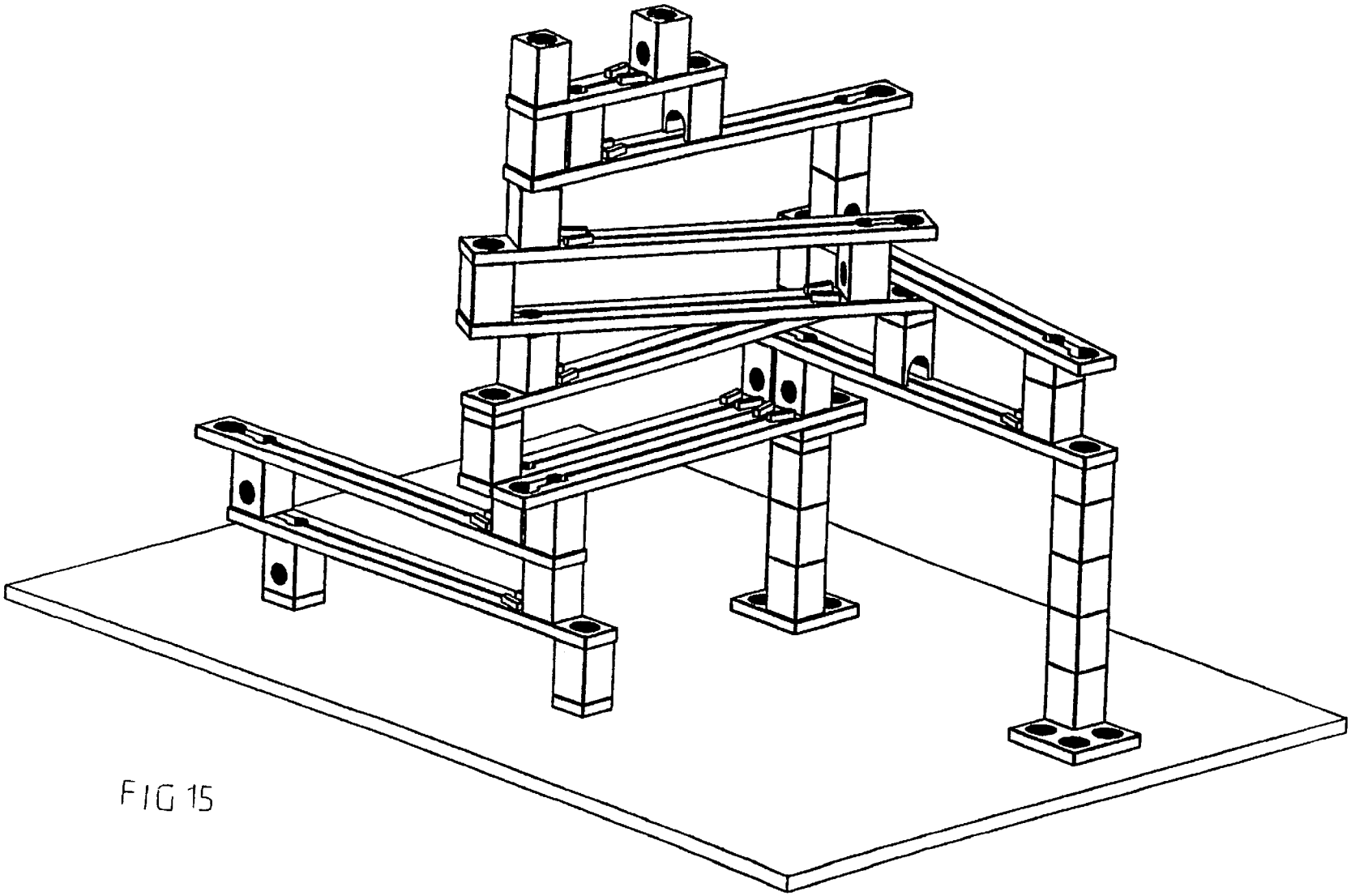
Figure 16A:
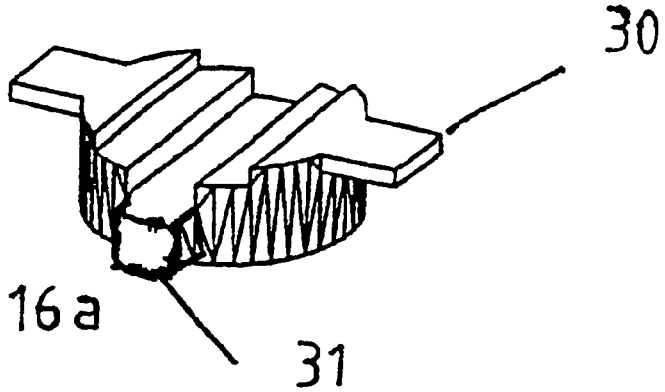
Figure 16B:
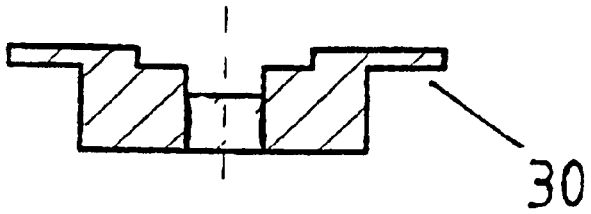
Figure 17B:
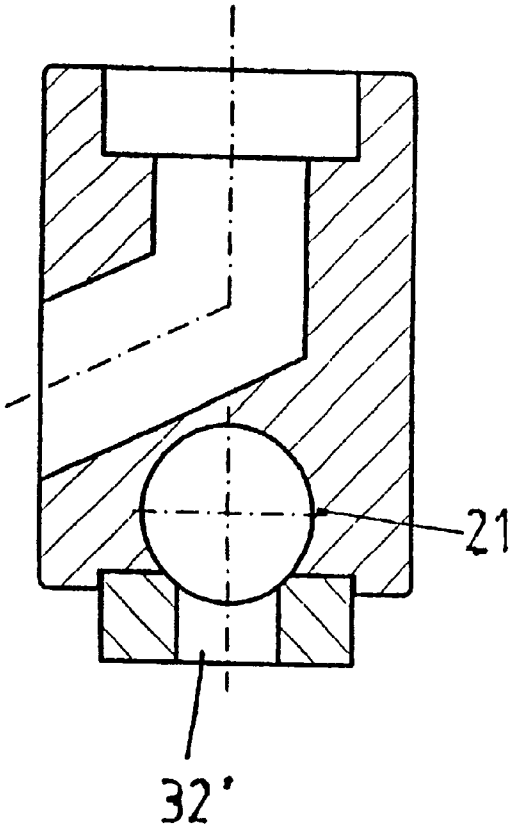
Figure 17A:
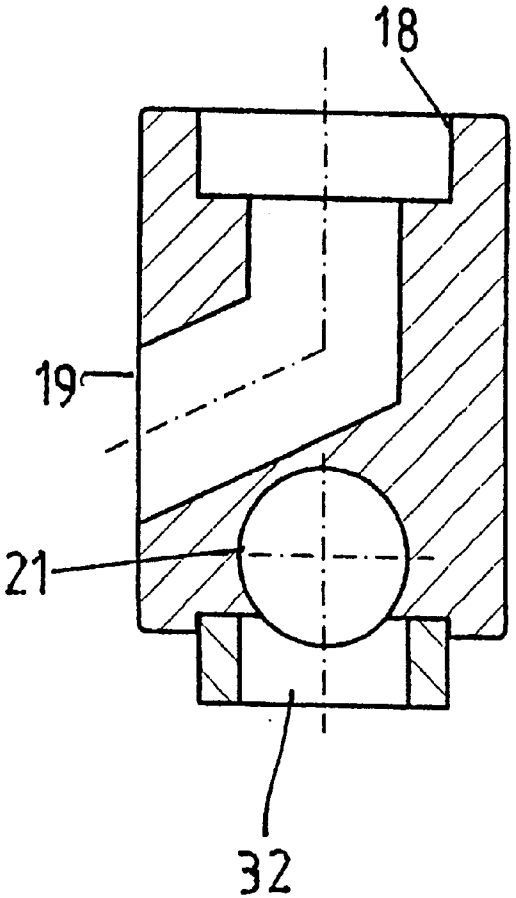
Figure 18A:
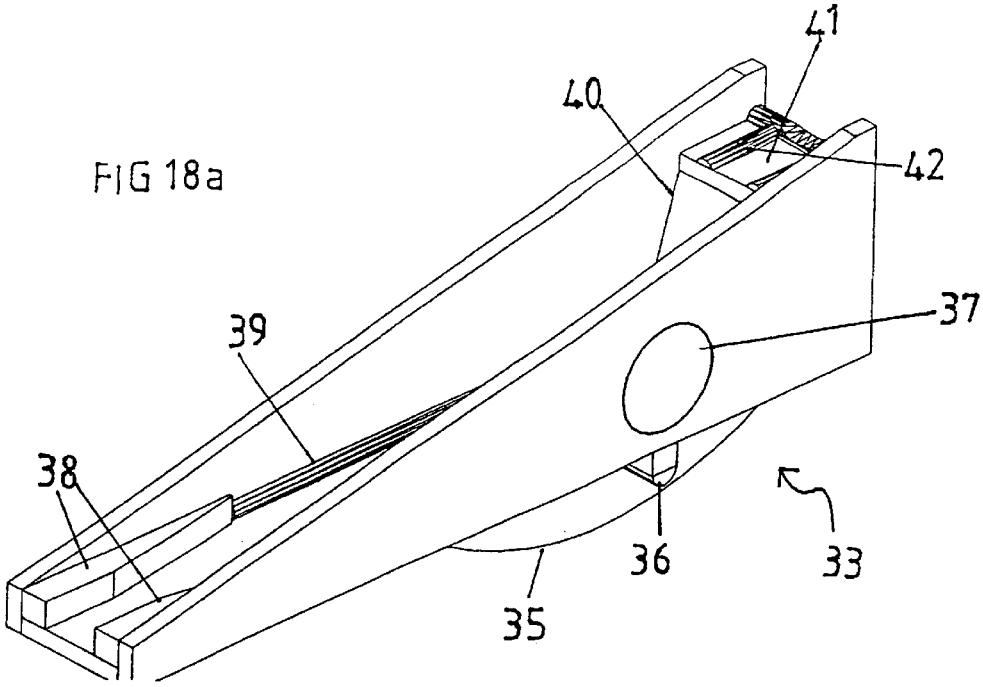
Figure 18B:
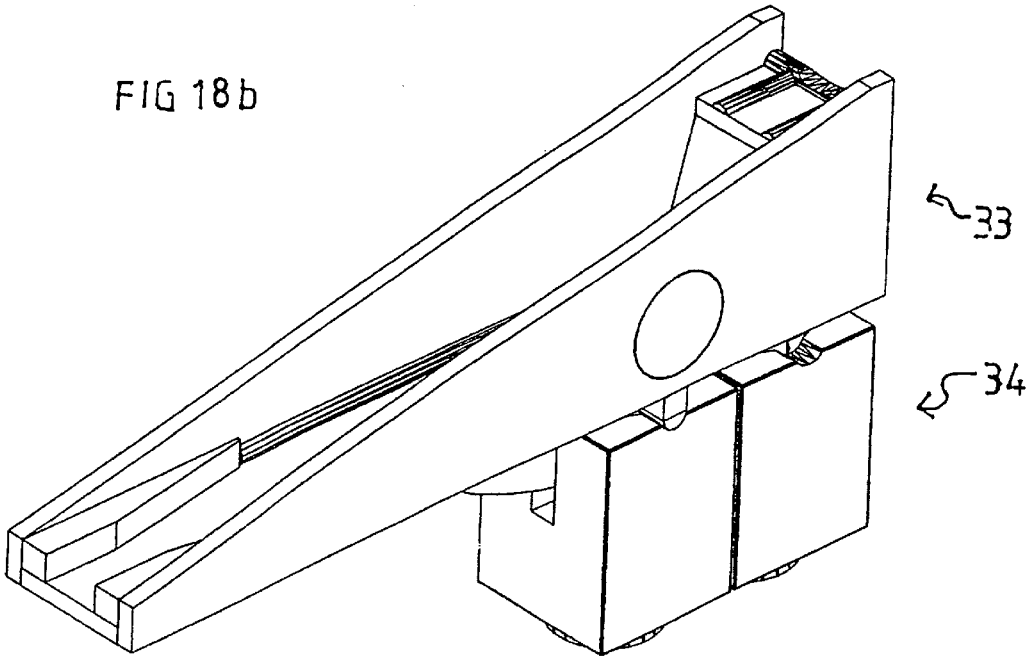
Figure 19:
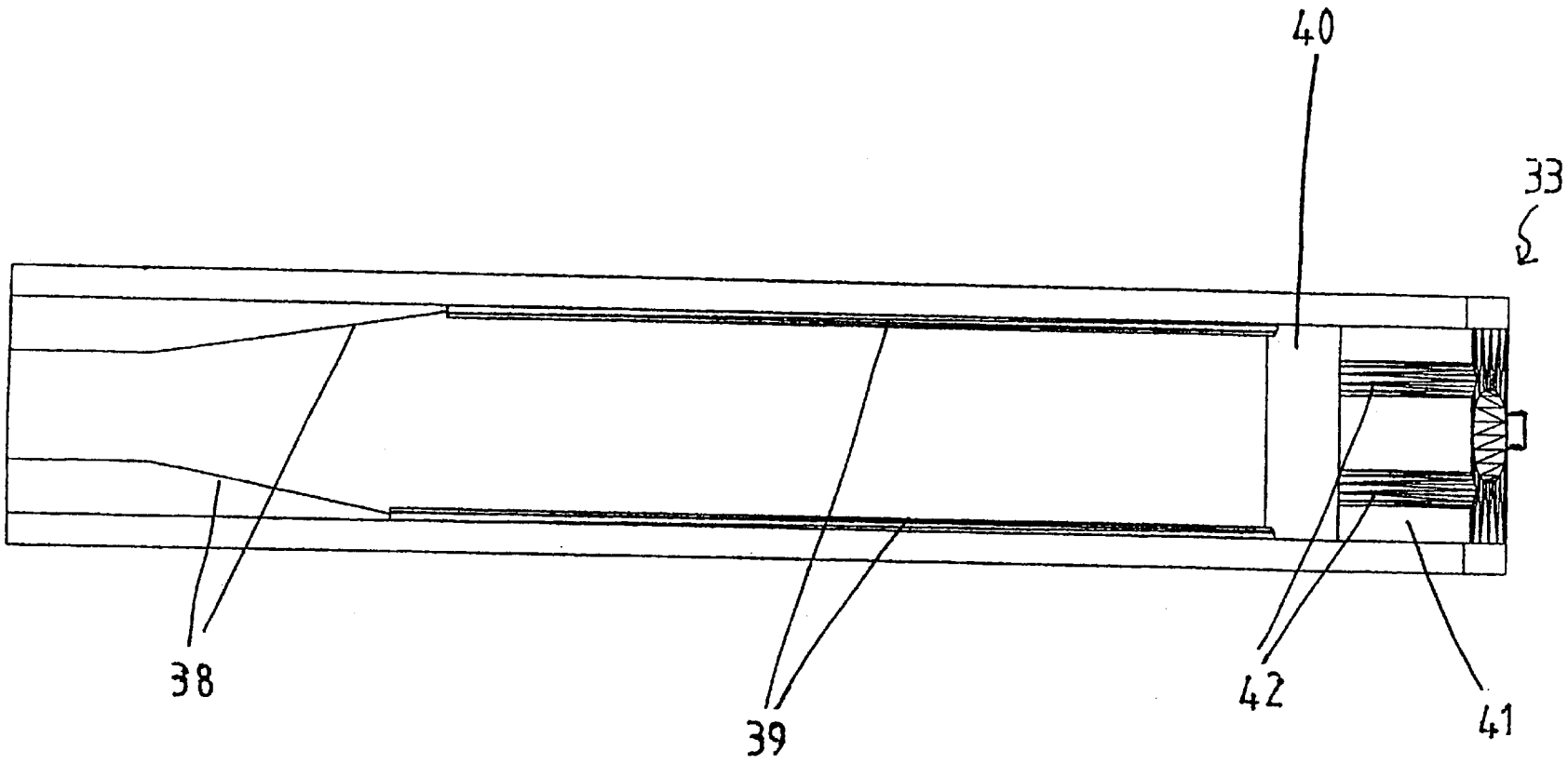
Figure 20A:
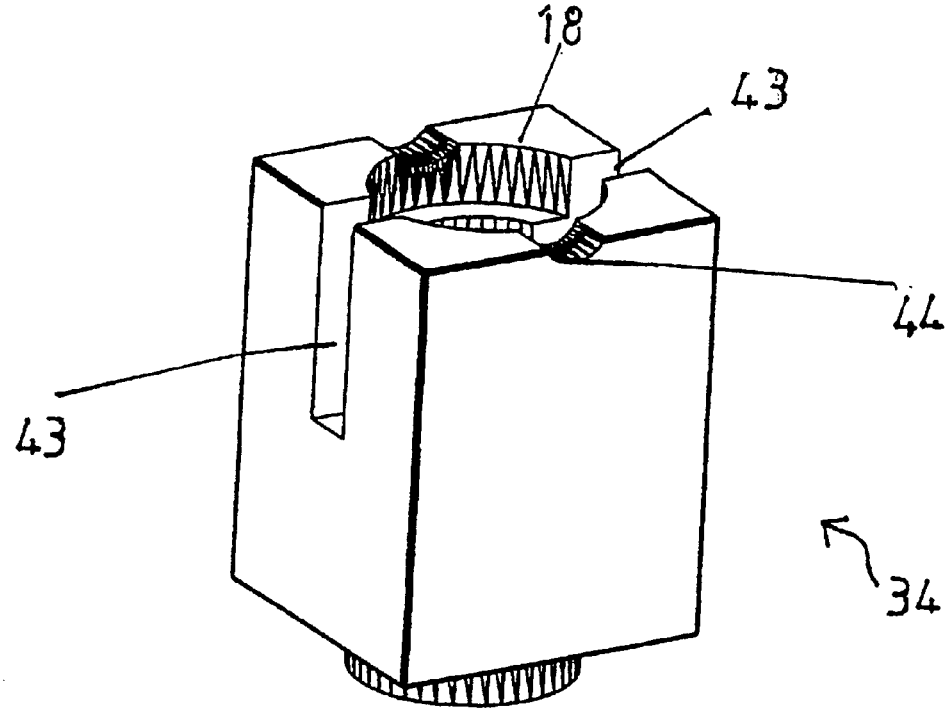
Figure 20B:
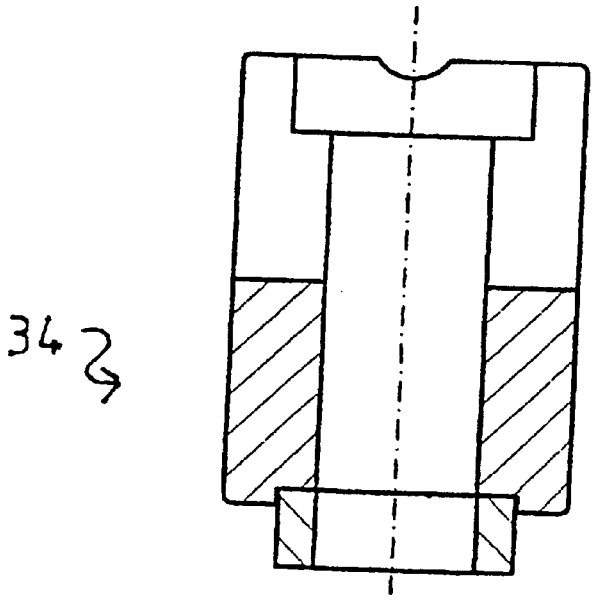
Figures 21A, 21B:
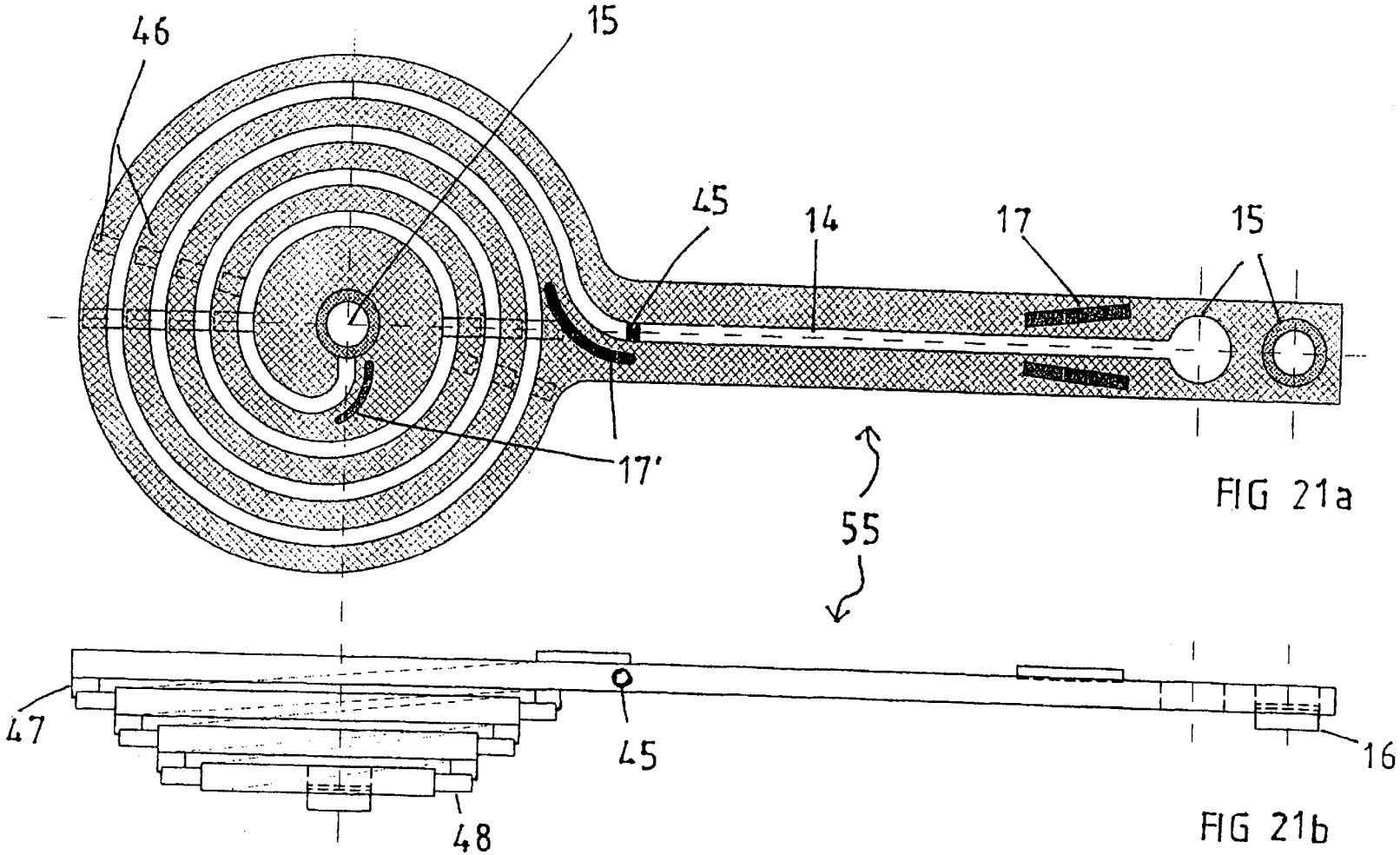
Figure 22A:
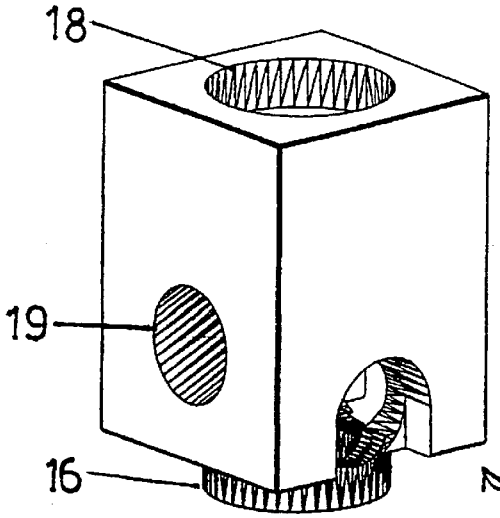
Figure 22B:
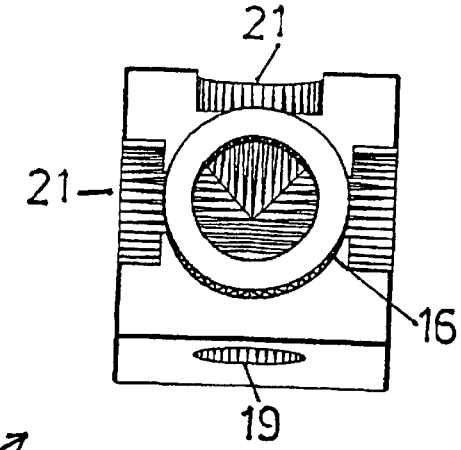
Figure 22C:
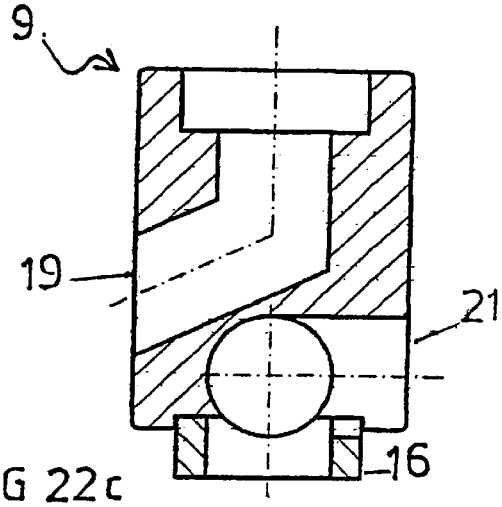
Figure 23:
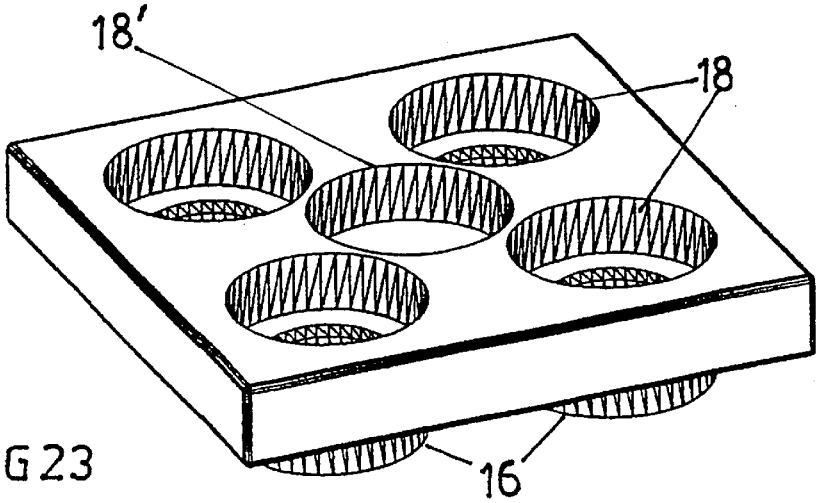
Figure 24A:
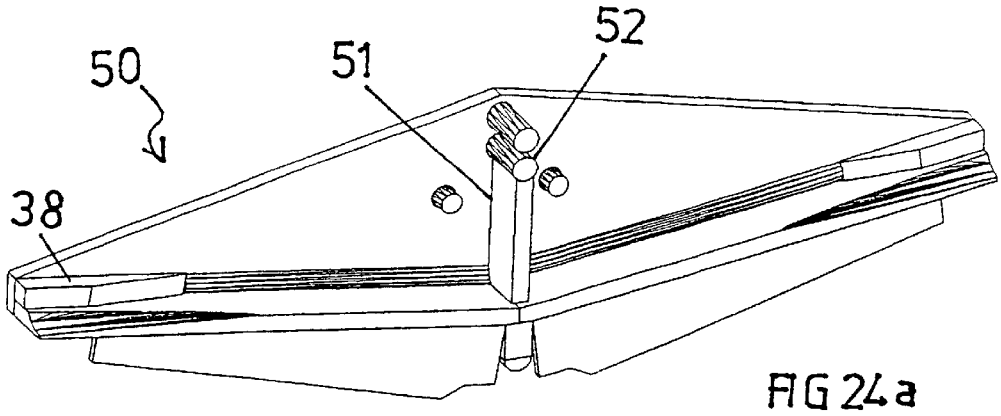
Figure 25:
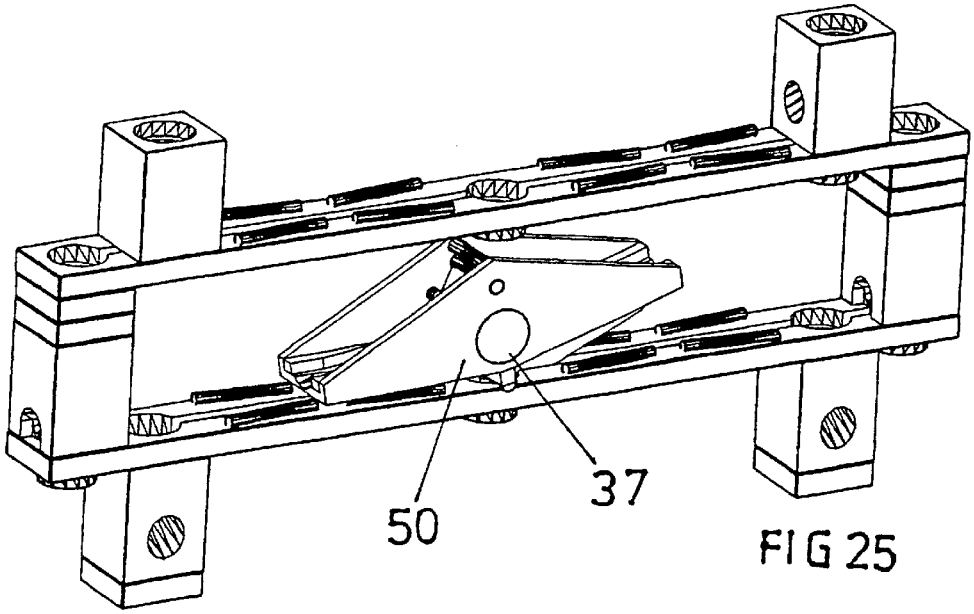
Figure 26A:
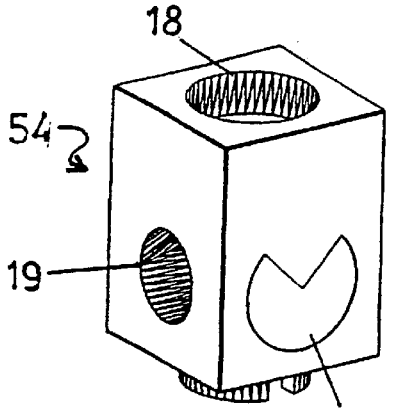
Figure 26B:
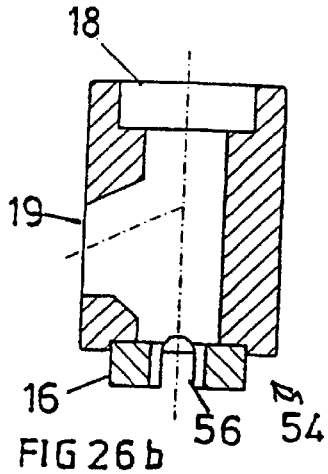
Figure 27C:
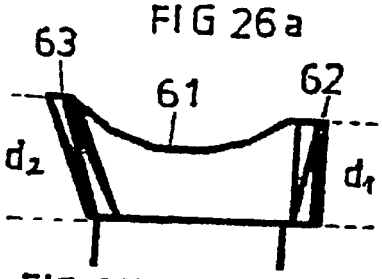
Figure 27A:
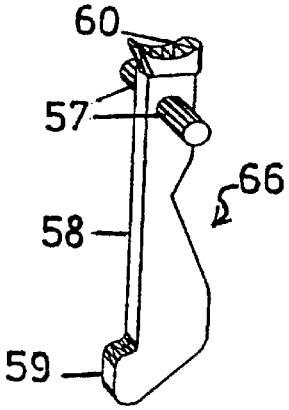
Figure 27B:
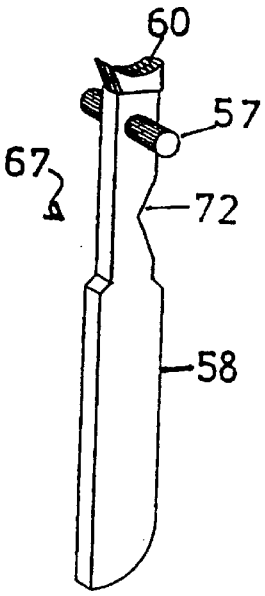
Figure 28:
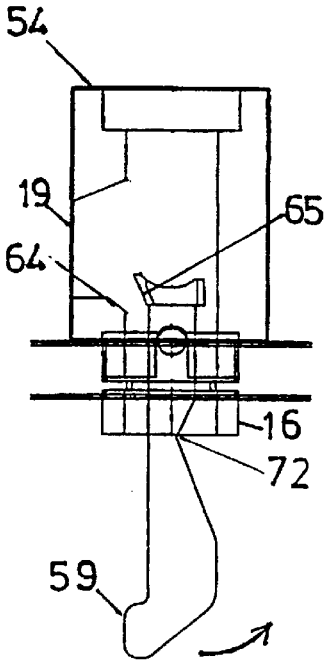
Figure 29A:
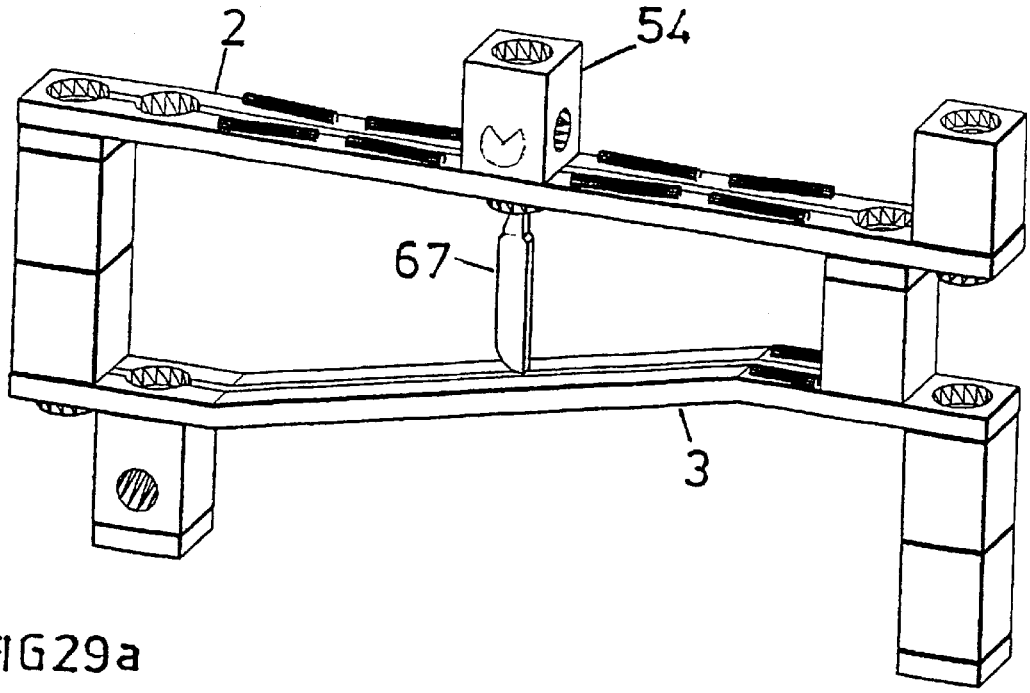
Figure 29B:
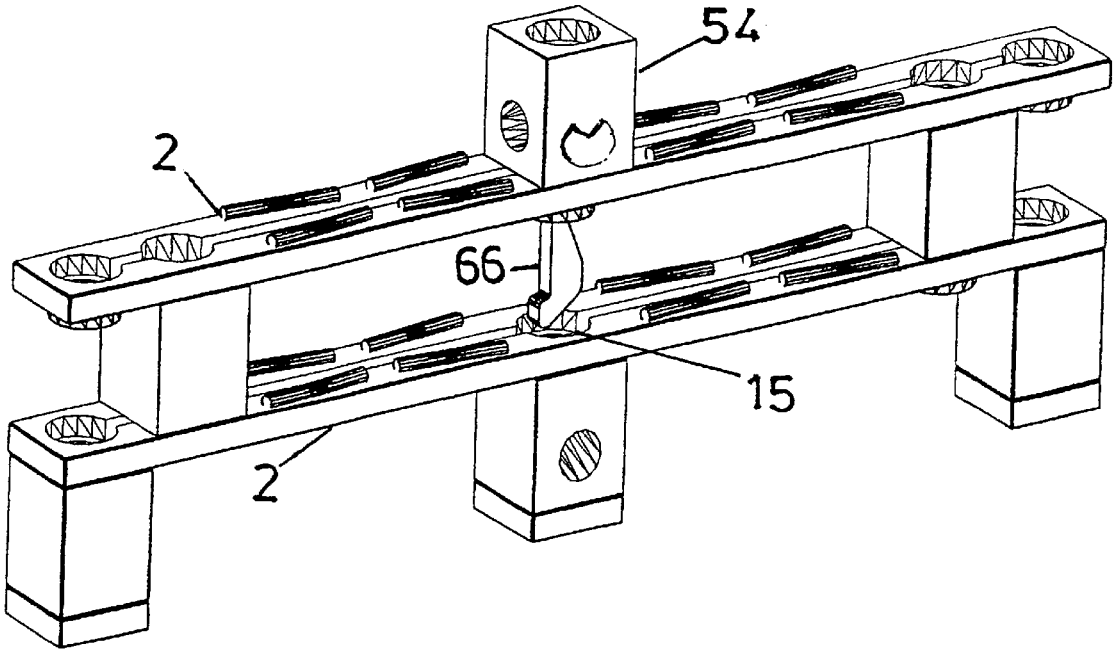
Figure 33A:
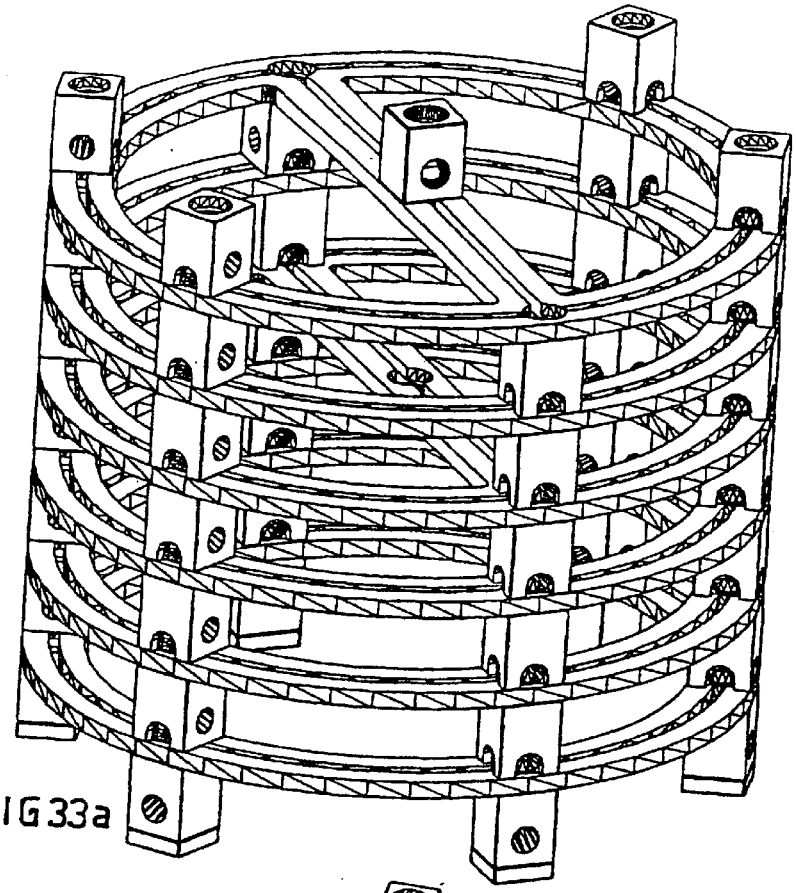
Figure 34A:
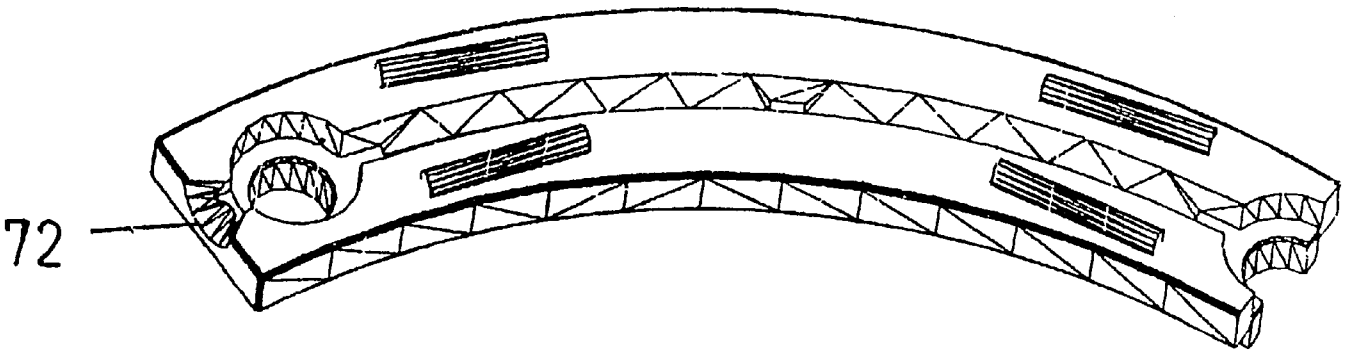
Figure 34B:
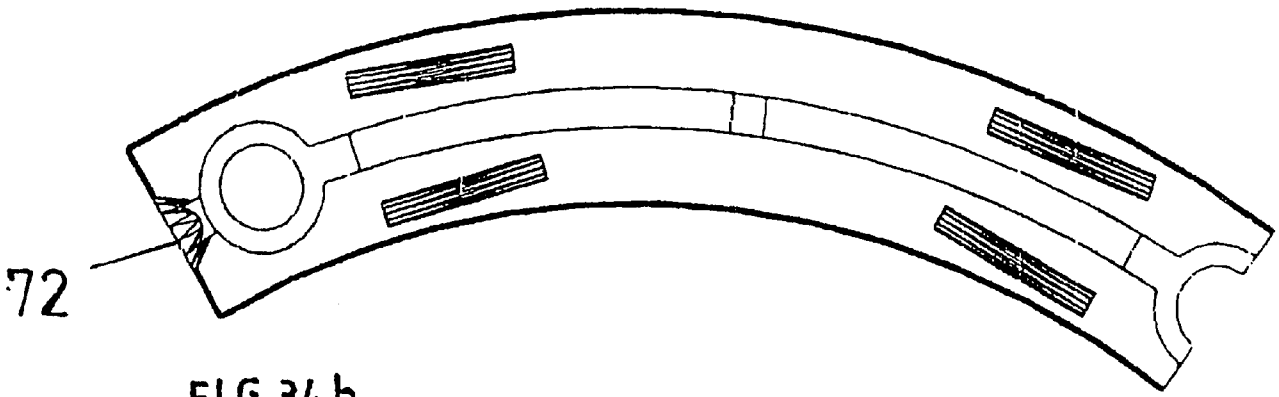
Figure 35A:
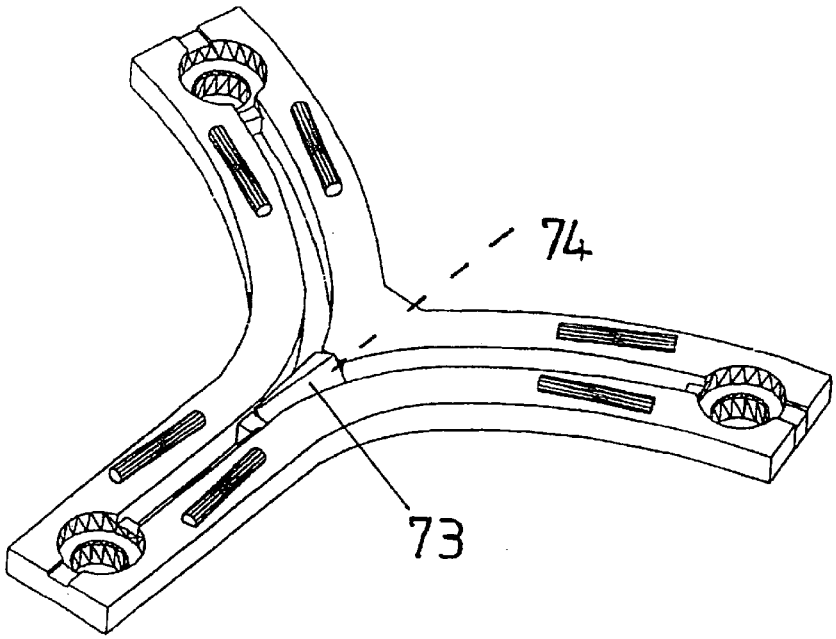

Further advantages, features and possibilities for application of the present invention will become clear with reference to the following description of a preferred embodiment and the accompanying drawings. There is shown, in:

FIGS. 1*a*) and 1*b*) a perspective side view and a plan view of a planar running track with four through bores, FIGS. 2*a*) and 2*b*) a perspective side view and a plan view of a running track with five through bores, FIGS. 3*a*) and 3*b*) a perspective side view and a plan view of a running track with four through bores, the central track section of which is inclined, FIGS. 4*a*) and 4*b*) a perspective view and a sectional drawing of a connecting element or respectively a stabilising element, with a through bore, FIGS. 5*a*) and 5*b*) a perspective view and a sectional drawing of a connecting element the thickness of the running track with a through bore and a hollow cylinder fixed coaxially thereto on the underside, FIGS. 6*a*) and 6*b*) a perspective view and a sectional drawing of a connecting element double the thickness of the running track with a through bore and a hollow cylinder fixed coaxially thereto on the underside, FIGS. 7*a*) and 7*b*) a perspective view and a sectional drawing of a connecting element with an upper bore section and a side aperture, FIGS. 8*a*) and 8*b*) a perspective view and a sectional drawing though a tunnel element without any projection, FIGS. 9*a*) and 9*b*) a perspective view and a sectional drawing through a tunnel element with a projection, FIGS. 10*a*) and 10*b*) a perspective view and a sectional view of a connecting element with two side apertures, FIGS. 11*a*) and 11*b*) a perspective view and a sectional view through a tunnel element with an upper and side aperture, FIGS. 12*a*) and 12*b*) a perspective view and a sectional drawing of a connecting plate with two through bores, FIGS. 13*a*) and 13*b*) a perspective view and a sectional drawing of a connecting plate with four through bores, FIG. 14 a ball track assembled simply, FIG. 15 a ball track assembled in a complex manner, FIGS. 16*a*) and 16*b*) a perspective view and a sectional drawing of a bridging element, FIGS. 17*a*) and 17*b*) a tunnel element similar to that shown in FIG. 11, and a corresponding sorting element, FIGS. 18*a*) and 18*b*) two perspective views of a tipping element without and with connecting element, FIG. 19 a plan view of a tipping element, FIGS. 20*a*) and 20*b*) a perspective view and a sectional view of a connecting element that is suitable for receiving the tipping element, FIGS. 21*a*) and 21*b*) a plan view and a side view of a spiral element, FIGS. 22*a*), 22*b*) and 22*c*) a perspective side view, a perspective view from below, and a sectional drawing through a tunnel element with an upper and three side apertures, FIG. 23 a perspective view of a connecting plate with five through bores, FIGS. 24*a*) and 24*b*) respectively a perspective side view of a tipping element with two receiving devices and a separating device, FIG. 25 a perspective view of an assembled ball track with a tipping element with two receiving means, FIGS. 26*a*) and 26*b*) a perspective view and a sectional view of the body of a blocking element, FIGS. 27*a*), 27*b*) and 27*c*) a perspective view of two different embodiments of the clapper of the blocking device, and a detail enlargement of the clapper saddle, FIG. 28 a drawing of the view though the assembled blocking element, FIGS. 29*a*) and 29*b*) respectively a perspective view of a ball track with a blocking element, FIGS. 30*a*) and 30*b*) a plan view and a perspective view of a circular running track, FIGS. 31*a*) and 31*b*) a plan view and a perspective view of a 60° circle segment running track, FIGS. 32*a*) and 32*b*) a plan view and a perspective view of a 120° circle segment running track, FIGS. 33*a*) and 33*b*) respectively a perspective view of a ball track with circular running tracks and/or circle segment running tracks, FIGS. 34*a*) and 34*b*) a plan view and a perspective view of a 60° circle segment running track with a indentation, and FIGS. 35*a*) and 35*b*) respectively a perspective view of a points element.

Figure 1B:
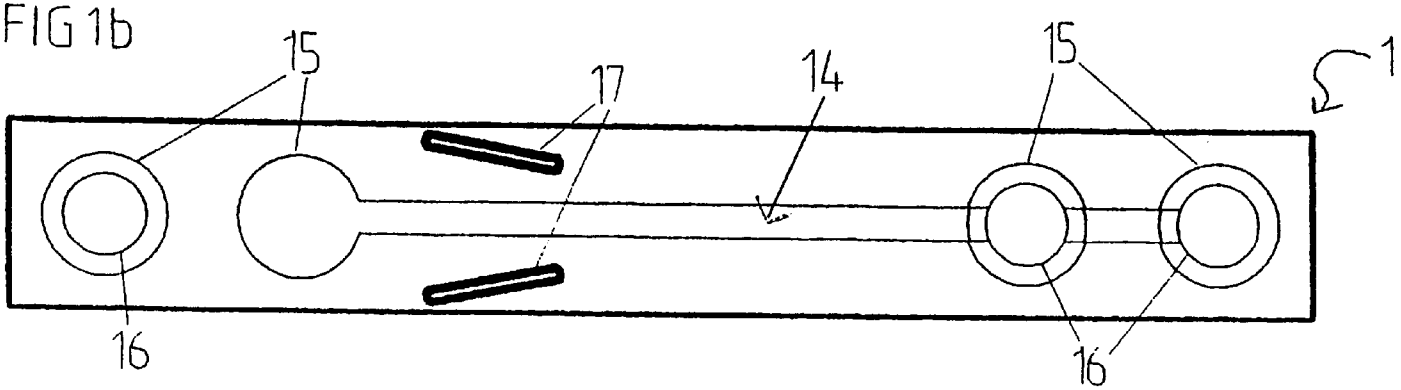
Figure 2B:
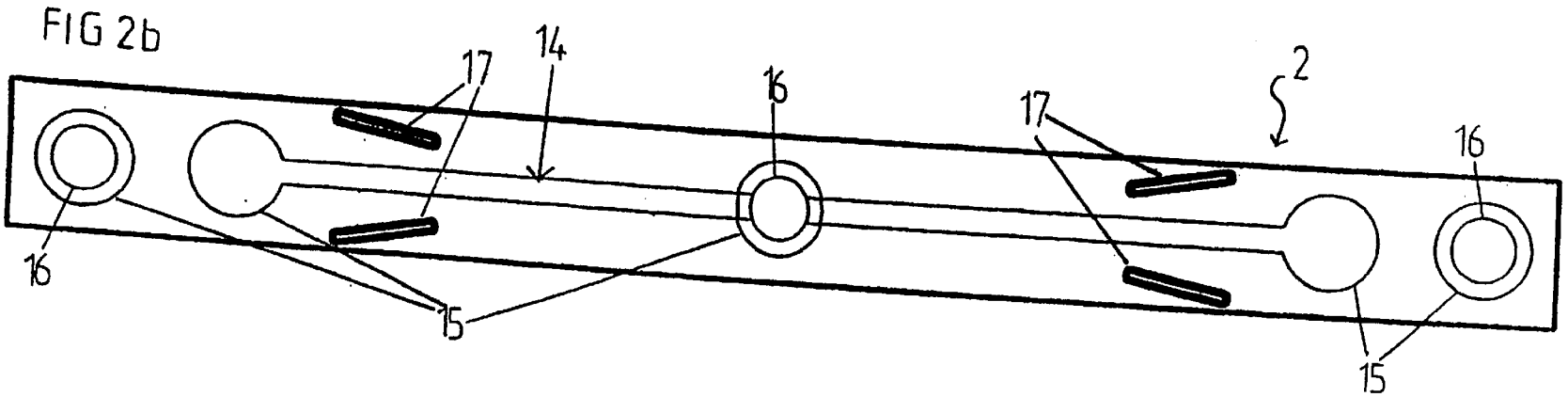
Figure 3B:
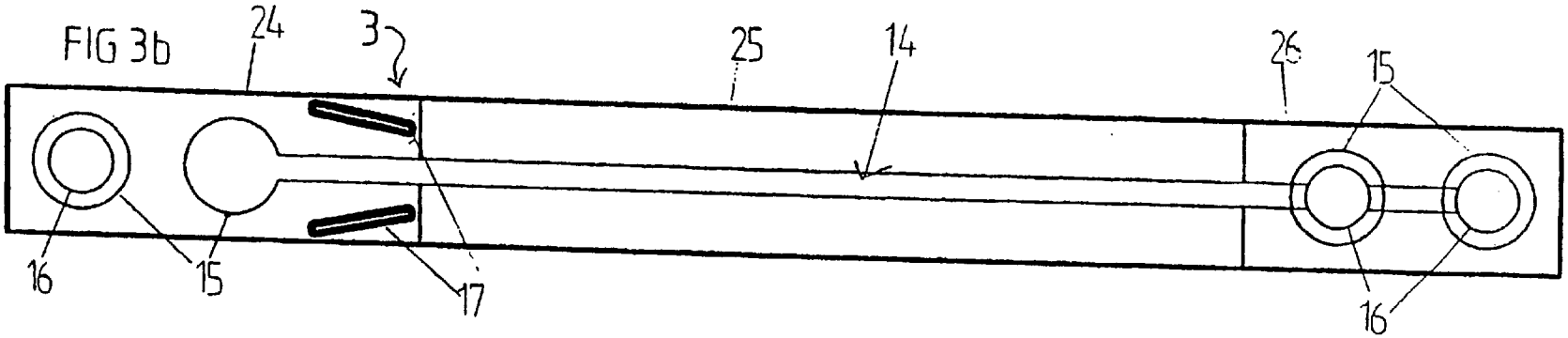

Three different variations of running tracks 1, 2, 3 are shown in FIGS. 1 to 3. They have a slot running longitudinally, a plurality of through apertures 15 that in some cases have on the underside, running coaxially thereto, a hollow cylinder 16, and guides 17. The outside diameter of the hollow cylinder corresponds to the diameter of the through apertures. The running tracks typically have lengths of approximately 25 cm to approximately 50 cm. The diameter of the through bore is preferably between 25% and 75% of the width of the running tracks. The running track width varies, according to the ball diameter, between 4 cm and 15 cm. Through bores are respectively present in pairs close together on the end sections of the running tracks. However, it is ensured that two connecting elements can be placed next to one another on the through bores. The, for example, tab or half-cylinder type guides 17 are fitted in the proximity of a through bore in the direction of the centre of the track, and are a smaller distance apart from one another in the direction of the centre of the track than in the direction of the track ends. In this way it is ensured that the balls are guided on the running channel.

Clearly, the size ranges described hereinabove are not absolutely fixed, but instead have simply proved to be advantageous ranges in practice. The running tracks could clearly also have dimensions that are outside the ranges described.

FIG. 2 shows a running track that additionally has a through bore 15 made approximately in the centre. This additional through bore significantly increases the variability of the present ball track. Running tracks are also particularly advantageous that have two additional through bores 15 that are arranged approximately in the centre. The two additional through bores are advantageously spaced sufficiently far apart that a connecting element can be placed respectively on each through bore at the same time.

While the tracks in FIGS. 1 and 2 are configured as planar, the track in FIG. 3 has two planar end sections 24, 26 and a central track section 25 that is inclined with respect to the horizontal.

Figure 4B:
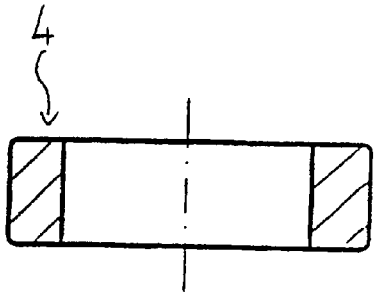

In FIG. 4 there is shown a substantially rectangular connecting element 4 with a through bore 18. The thickness of this connecting element corresponds to the thickness of the running track. This element also acts to stabilise connecting elements and running tracks that have to be placed on the ground, and have a cylinder or respectively a hollow cylinder on their underside.

In FIGS. 5*a*) and 5*b*) a connecting element 5 is shown that in addition to the features of FIG. 4 has a hollow cylinder 16 axial to the through bore 18, which hollow cylinder is fitted on the underside of the connecting element. The through bore 18 is tapered stepwise towards the underside, so that the diameter of the tapered bore corresponds to the inside diameter of the hollow cylinder 16 and the further bore corresponds to the outside diameter of the hollow cylinder. This connecting element is configured such that one the one hand the balls can pass through both through bores 18 and hollow cylinders 16, and on the other hand the hollow cylinder 16 can be placed in both the running tracks and the connecting elements. The parts assembled in this manner cannot be displaced relative to one another in the horizontal direction. It is possible, however, to rotate both parts counter to one another about an axis corresponding to the axis of the hollow cylinder and the bore.

Figure 5B:
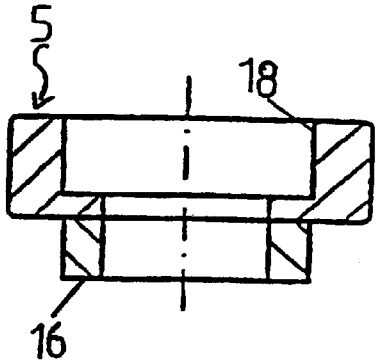
Figure 6B:
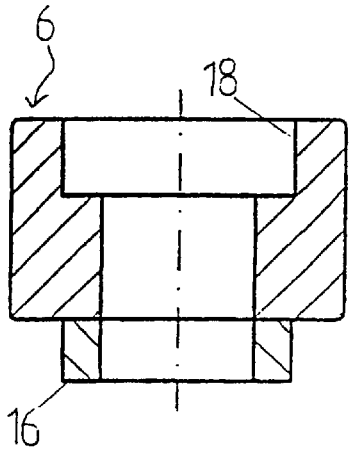

The connecting element designed 6 in FIG. 6 differs from the connecting element in FIG. 5 only by a different effective height.

Figure 7B:
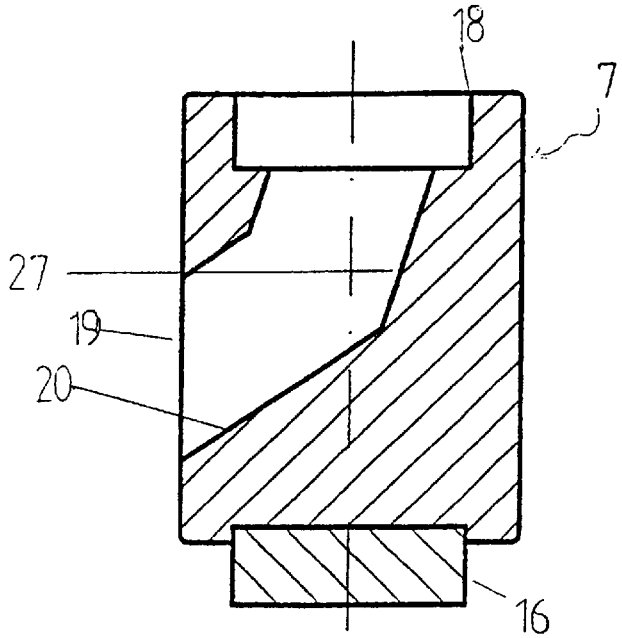

A connecting element is shown in FIG. 7 that shows a side aperture that is connected to the upper bore section 18. A bore section 20 of the bore within the connecting element is inclined with respect to the horizontal. A further bore section 27 has a greater incline compared to the bore section 20. Clearly, the bore section 27 can also run vertically. The inclined bore section 20 that clearly can also be curved, ensures that a ball that falls through the upper bore in the connecting element gains a horizontal speed component when passing through the connecting element. The connecting elements have a height corresponding to a whole number multiple of the running track thickness. The connecting element 7 must additionally satisfy the requirement that the height of the connecting element 7 is at least large enough for a ball passing through the connecting element 7 gains sufficient horizontally directed acceleration for the ball to pass along the running track to the point determined. The side aperture is provided high enough for the connecting element 7 with the cylinder to be able to be inserted in a through bore of a running track, and a further running track can be laid or inserted on the first running track adjacent to the connecting element 7, and a ball passing through the connecting element is guided onto the second running track.

Figure 8B:
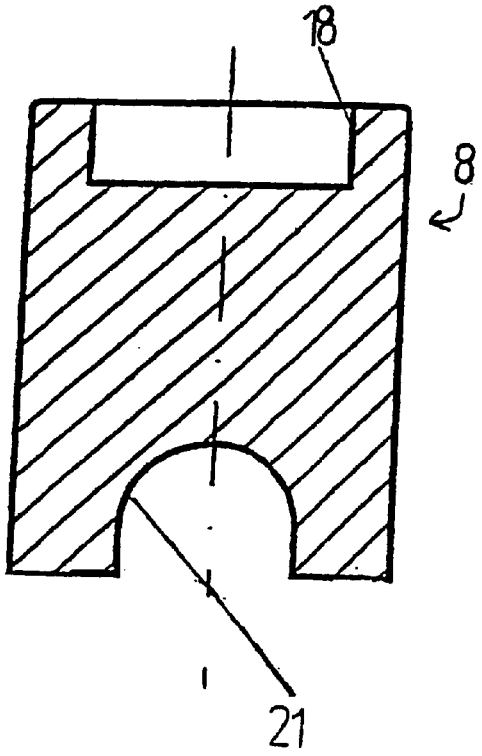

The connecting element 8 shown in FIG. 8 has an upper bore section 18 and a tunnel-type passage 21. The bore section 18 is not tapered in this connecting element. This connecting element can, in principle be placed anywhere on the running tracks 1, 2 such that the balls rolling on the running channel can cross through the tunnel-type passage. The upper bore 18 allows that further running tracks and/or connecting elements proceeding from this connecting element can be built upwards.

Figure 9B:
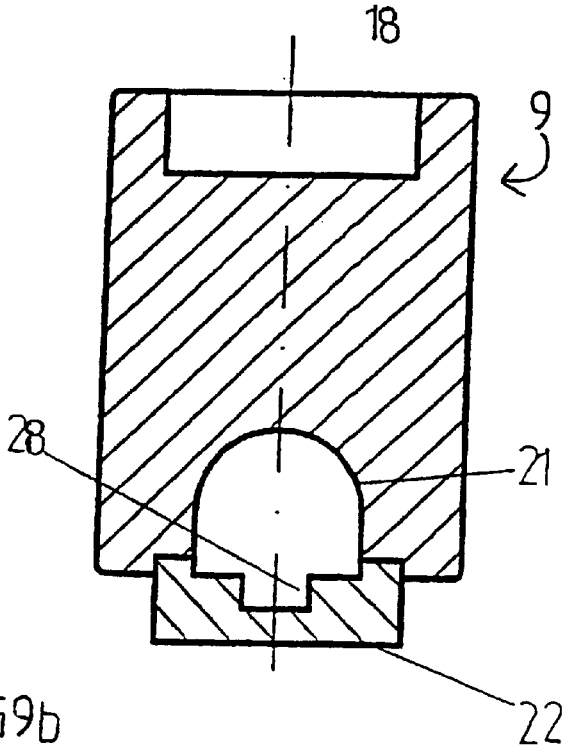

Compared to the connecting element 8, the connecting element designated 9 in FIG. 9 has a cylinder 22 additionally fitted on the underside. The cylinder 22 has a channel 28 on its side face in the tunnel-type passage 21, the width of which channels corresponds to the width of the running channels 14 of the running rails, and which run parallel to the tunnel-type passage 21. This cylinder can latch into the through bores of the running tracks 1, 2, 3 so that the balls running through the running channel 14 can roll through the tunnel-type passage 21 of the connecting element 9 without falling into the through bore closed by the cylinder 22.

Figure 10B:
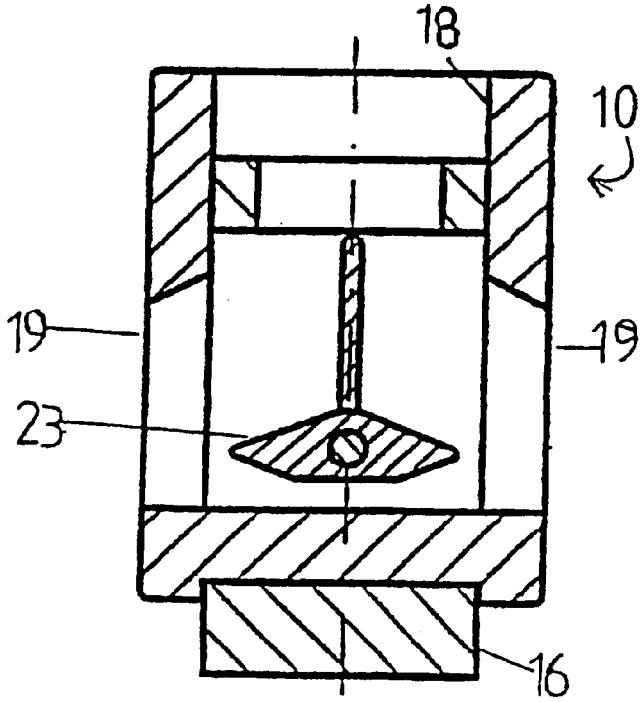

FIG. 10 shows a connecting element with two side exit apertures 19. It is ensured by means of the apparatus 23 that a ball that enters through the upper bore section 18 into the connecting element 10, exits through one of the two side exit apertures 19 with a horizontal speed component. The apparatus 23 is provided with a diverting mechanism that switches balls falling through between one and the other side exit aperture 19. It can also equally well be mounted in a fixed manner so that the ball randomly uses one of the two side exit apertures 19, or be manually or remotely moveable so that the user can decide which side exit aperture 19 will be used by the ball.

FIG. 11 shows a connecting element 11 that has an upper bore section, a side exit aperture 19, and an inclined or respectively curved bore section 20 and a tunnel-type passage 21. This element can be of assistance in the construction of a ball track with several ball paths. While with one ball path a ball on a running track rolls into the tunnel-type passage 21, and falls into a bore hole located below the connecting element 11 in the assembled state, or into the bore section 18 of a running track or a further connecting element, a further ball path can provide entry of a ball through the upper bore section 18 of the connecting element 11 and the exit, with horizontal acceleration, from the side exit aperture 19. Two different configurations of such a connecting element are also shown in FIGS. 17*a*) and 17*b*). Apart from a slightly different configuration of the tunnel-type passage, FIGS. 17*a*) and 17*b*) differ in that the sizes of the vertical exits 32 and respectively 32' are different. The connecting element shown in FIG. 17*b*) acts as a sorting element so when, for example, a running track is placed on a through bore, only balls with a smaller size than the size of the exit 32' can pass through the running tracks, while the remaining balls remain largely unhindered on the running tracks, and pass completely through the tunnel-type passage. Clearly an embodiment can also be implemented in which both the upper bore section 18 is connected to a side exit aperture 19 and three side tunnel-type apertures are provided. Such a connecting element 49 is shown in FIGS. 22*a*), *b*) and *c*). A ball can therefore be supplied sideways to this connecting element 49 from three different sides, which ball then leaves the connecting element 49 through the lower exit aperture. Advantageously, this element can be placed on a running track with at least one through bore arranged substantially centrally. In this case, for example, a ball can on the one hand be guided by means of the ball path through the upper bore 18, and the side exit aperture 19 on the running track, while on the other hand a further ball path is made on the same track and leads downwards through the centrally arranged through bore of the running track.

Figure 12B:
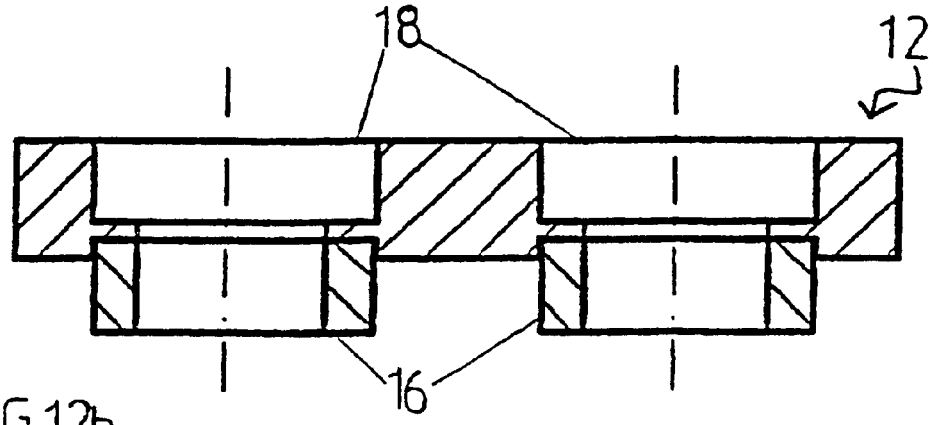
Figure 13B:
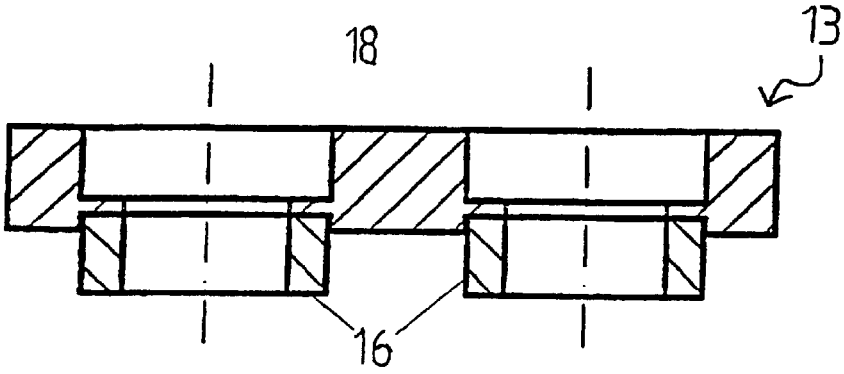

The connecting plates that are shown in FIGS. 12 and 13 also have upper bore sections 18 and hollow cylinders 16 running axially thereto, affixed on the underside. With these connecting plates, for example, two or more adjacent connecting elements can be prevented from sideways relative movements. Such connecting plates can also serve to construct stepped arrangements of the connecting elements. Additionally, connecting plates with three bore sections, which are arranged in rows, are advantageous. It is also advantageous when some of the connecting plates shown in FIG. 13 have a further bore 18' that is arranged approximately centrally. Such a connecting plate is shown in FIG. 23. It is then possible, for example, to place a connecting element with a side aperture on the central bore 18', and to orientate the connecting element such that a ball that falls into the connecting element is guided through the side aperture into one of the outer holes 18.

A very simple construction of a ball track is shown in FIG. 14. Two lower connecting elements 7 engage by means of the hollow cylinder or cylinder located on the underside with the connecting element 4. In this way secure standing on the base is ensured. The running track 1 is now latched, with the aid of its hollow cylinder located on the underside, into the upper bore aperture of the lower connecting element 7. Yet a further connecting element 7 is located on the running track 1. A ball can now be thrown into the upper aperture of the upper connecting element 7. When passing through this connecting element, because of the inclined or curved bore section, the ball gains a horizontal acceleration. It then rolls along the running channel of the running track 1 until it falls into the next though hole of the running track 1.

By means of the connection of the running track 1 with the connecting element 7 located beneath it, it is ensured that the ball falls into the lower connecting element 7. Here, it again gains a horizontal acceleration and leaves the connecting element 7 from the side aperture.

FIG. 15 shows a complicated construction of the ball track. A plurality of different ball paths is implemented in a single construction. All the running rails lie horizontally on the connecting elements or other running rails. In this way, and by means of the rotatable fixing by means of the hollow or respectively solid cylinders and the bore sections 18, an extremely stable construction is possible. In principle, there are no limits to the height of the ball track. Providing sufficient running tracks and connecting elements are available, metre-high constructions are possible. The ball track also does not necessarily have to be manufactured from wood. Ball tracks are also conceivable that of transparent materials, for example, plexiglass. In this way when coloured balls or other rollable elements are used, a visual effect is obtained.

The bridging element shown in FIGS. 16*a*) and 16*b*) serves to bridge through bores on the running tracks. If, for example, the ball paths are to be altered in an already constructed ball track, a through bore of a running track can very much get in the way. If the bridging element is then placed in this bore, a ball can pass along the running track over the bore. The bridging element in this configuration is provided with retaining arms 30 that prevent the bridging element falling through the through bore. Additionally, the bridging element also has a guideway for passing balls and a projection 31 that ensure that the bridging element or respectively the guideway is orientated parallel to the running track and twisting of the bridging element during use is excluded. Clearly, the connecting element shown in FIG. 9 can also be as a bridging element. In this case, the bridging element can at the same time serve as a supporting point for a further running track.

A tipping element 33 is shown in FIGS. 18*a*), 18*b*) and 19. The tipping element 33 can be put with the aid of the guide tab 35 in a running track or onto a suitable connecting element 34 so that it lies on the bearing pivot 36. The tipping element has a substantially U-shaped cross-section in the longitudinal direction. The balls are guided into the tipping element such that they arrive on the surface 41 of the tipper box that is formed by the surfaces 40, 41 and the limb surfaces of the U-shape. By means of the random elements 42 that in this instance are substantially semi-cylindrical, the balls are guided into the tipper base. The configuration of the tipper box, that is to say the weight of the tipper box, ensures that in the empty state, the tipping element is in the receiving position, so that it is tipped clockwise about the bearing pivot 36 in FIGS. 18*a*) and *b*). Balls arriving reach the tipper base and at first lie on the slightly inclined surface 40. If the number of balls in the tipper element 33 increases, ever more balls must assume a position that lies to the left of the bearing pivot or respectively bearing pivots 36 in the Figures. From a certain number of balls onwards, the receiving position of the tipper element becomes unstable, and it tips about the bearing pivot 36 counter-clockwise to the left, and releases at least some of the balls. The quarter cylinders 39 prevent a plurality of balls jamming against one another in the tipper element 33. The guide elements 38 that are configured asymmetrically, ensure that when the balls are released, the balls are consecutively released onto, for example, running track. The tipper element has a visual characteristic 37 that should make the player aware of the tipping capability of the tipper element 33. The visual characteristic can be, for example, be made using coloured markings.

The number of balls that the tipper element can receive until it becomes unstable and releases at least some of the balls again, is determined inter alia by the weight of the tipper box. It is therefore also possible for the advanced user to provide weights that can be mounted as required in the tipper boxes so that the user can influence the receiving capability of the tipper element 33.

As described already, the tipper element 33 is principally designed to be placed on a running track. It is also possible, however, to place the tipper element 33 on special connecting elements 34, that are shown in FIGS. 20*a*) and 20*b*). The connecting element 34 has a guide slot 43 for receiving the guide tab 35 and indentations for receiving the bearing pivot 36.

Figure 24B:
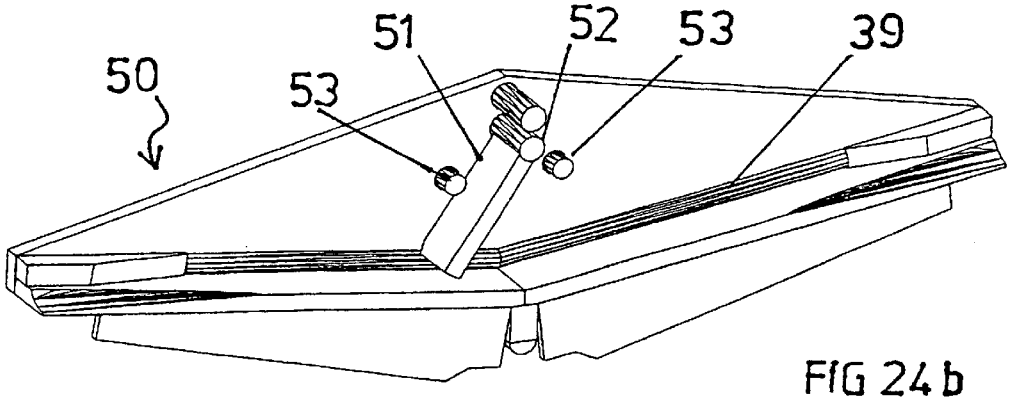

FIGS. 24*a*) and 24*b*) show a tipper element 50 with two receiving means, wherein one is respectively in the receiving position and the respective other one is in the release position. In order to make the manner of functioning clear, in FIG. 25 a ball track is shown that is provided with a tipper element 50 with two receiving devices. In the position shown, a ball passing though the central bore of the upper running track falls into the right-hand receiving means. As soon as this position becomes unstable, the tipper element tips in the clockwise direction, so the right-hand receiving means goes into the release position and releases the balls received to the right onto the lower running track, while the left-hand receiving device goes into the receiving position so that the balls now falling though the central hole of the upper running track arrive in the left-hand receiving means. As can be seen in particular in FIGS. 24*a*) and 24*b*), the tipper element 50 has a separating wall 51 that is rotatable or respectively pivotable by means of the bearing pivot 52. In addition two stops 53 are provided that limit the pivoting radius of the separating wall in order to prevent complete opening of the separating wall 51. In the configuration shown here, the separating wall can be moved simply on the basis of the intrinsic weight of the balls. The balls fall, for example, in the position shown in FIG. 24*a*), into the right-hand receiving device. The balls are pressed by gravity against the separating wall 51, and the separating wall 51 moves to the left against the stop 53 into the position shown in FIG. 24*b*). The receiving capacity of the receiving means can easily be increased using this clever construction, without the tipper element assuming overly large dimensions. After the right-hand receiving means has reached its maximum receiving capacity, becomes unstable, and goes into the release position, the following balls arrive in the left-hand receiving means. Again, the separating wall 51 is moved solely by the force of the weight of the balls, but this time to the right as far as the right-hand stop 53. In this position, the receiving capacity of the left-hand receiving means is increased, while at the same time the receiving capacity of the right-hand receiving means is reduced. The smaller capacity of the right-hand receiving means is unimportant, however, as it is in the release position anyway, and therefore cannot receive any balls at all.

In FIGS. 21*a*) and *b*), a spiral element 55 is shown. It is composed of a running track section with a ball guide 14 and through bores 15, and a spiral section that guides the balls on a conical and spiral-shaped path. The manufacturing of the spiral element 55 shown is very simple. In an approximately ladle-shaped body, there is a continuous channel that runs on the running track section (corresponding to the ladle handle) parallel to the running track and in the spiral section (corresponding to the actual ladle) in a spiral shape. Using a suitable choice of material (for example, wood), it is possible, as shown in FIG. 21*b*), to move the inner part of the spiral section downwards. By means of suitable supporting elements 48, the spiral section can be fixed in its "extended" position. The embodiment shown here has the further advantage that the supporting elements 48 are mounted in a fixed manner and depressions 46 are provided on the underside of the spiral section, which depressions serve to receive the supporting elements 48 in the storage position. It is thus possible to somewhat rotate the innermost "ring" of the spiral element in the circumferential direction with respect to the outer "rings" and to bring the supporting elements 48 into the depressions 46. Securing elements 47 prevent accidental movements of the supporting elements 48.

The spacing element 45 provides stabilising. The guide elements 17' guide the balls during particularly critical travel on the track when entering and respectively leaving the spiral element. It is particularly notable that the balls on the spiral element do not run in the channel but on the tracks, so they are retained only by the walls lying further out. Inward departure from the tracks is prevented by centrifugal force. By means of this extremely simple design of the ball guideway, it is even possible to use such a spiral element as a "throw-in funnel". If, namely, the balls are thrown if possible in the right direction into the spiral section, the automatically find the suitable path and are guided inwards in a spiral shape. A connecting element with a side aperture or a tipper element can also be arranged above the spiral element such that the exit aperture is orientated approximately in the direction of an imaginary tangent on the spiral-shaped course of the ball.

The blocking element and the way it functions is shown in FIGS. 26 to 29. The embodiment shown here of the blocking element is composed of a body 54 that can also be considered as a specially designed connecting element, and can also serve as one, and a trigger device in the form of a clapper 66, 67. Two exemplary arrangements of such a blocking element in a ball track are shown in FIGS. 29*a*) and 29*b*). It is conceived here that at least one ball path runs such that balls arrive in the upper aperture of the body 54. The balls are retained by the saddle 60 of the clapper in the body 54. Only when a ball passes on the running track lying beneath, and deflects the clapper 66, 67, is just one ball released through the side aperture of the body. The clapper 66, 67 then swings back and the passage through the body 54 is again blocked. As is clear from the two exemplary arrangements, the path running below the body 54 can be either a running track 2 with a horizontal central section or a running track 3 with an inclined central section. Clearly, the clapper 66, 67 must where required be adjusted to the different distances apart of the adjacent running tracks.

FIGS. 26*a*) and 26*b*) show the body 54 of the blocking element in detail. The body has an upper bore 18 and a side exit aperture 19. In addition a lower bore is also present, through which the clapper 66, 67 can be guided into the body 54 and hung in a swinging manner. The body 54 also has a visual characteristic 37' that should make the user aware of the way the blocking element works. The swinging hanging of the clapper is indicated by the distinguishing mark 37'. The clapper 66, 67 is composed of the clapper arm 58, the pivot 57 and the saddle 60. The pivots 57 serve for the swinging hanging of the clapper 66, 67 in the body 54. For clarity, in FIG. 28 a view through the blocking element in its assembled state is shown. A ball that arrives in the upper aperture 18 of the body 54 firstly lands on the saddle 60 that has a concavely rounded saddle surface 61. Here, the ball is held securely and cannot leave the side exit aperture 19. If the clapper is now diverted manually or preferably by means of another ball in the direction of the arrow in FIG. 28, the saddle 61 moves to the left, until it strikes with the section 63 against a section 64 of the body 54. In this position the "hollow" of the saddle 61 is inclined far enough for the ball to leave through the side exit aperture 19. The clapper 66, 67 swings back and for the following balls, passage is blocked again until a following ball again diverts the clapper again and repeats the procedure.

The embodiment of the blocking element shown here has a particularly clever construction that reliably ensures that only one ball can leave the blocking element. The blocking element is thus configured according to the invention such that only when at least two balls are located in the body 54, actuation of the clapper 66, 67 ensures that a ball leaves the body 54 from the side aperture 19. The tipping of the saddle 60 is by itself not sufficient to move the lowest ball in the body to the side exit aperture, but rather the force of the weight of a further ball is additionally necessary, that acts upon the lower ball and presses the lower ball when the saddle 60 swings slightly to the side in the direction of the surface 64 of the body. Only when the saddle swings back, the edge 63 of the saddle 60 presses the ball sideways out of the body 54. Any returning of the ball to its original position is impossible as this is prevented by the force of the weight of the subsequent ball.

The saddle 60 has the shape shown in FIG. 27*c*). In cross-section, the saddle has a substantially rectangular form, wherein the uppermost surface 61, as described hereinabove, is concavely curved, so that a kind of hollow or cavity forms in which a ball can be held securely. It is clear from FIG. 27*c*) that the height of the rectangle on the side facing the exit aperture is greater than on the other side, that is to say $d_2<d_1$. The edge sections 62, 63 of the upper surface of the saddle 60 are not curved. As is also clear in FIG. 27*c*), the surface 65 of the saddle 60 facing the exit aperture is not completely arranged to run vertically, but has an incline. This incline is to be matched with the inclined bearing surface 64 of the body 54.

Both embodiments of the clapper 66, 67 shown have an indentation that serves to increase the swinging range of the clapper, as thereby stopping of the clapper on the hollow cylinder 16 of the body 54 takes place only when there is larger diversion of the clapper 66, 67. In particular when small balls are used, or when the clapper 66 is arranged directly above a through bore 15 of a running track, as is the case, for example, in FIG. 29*b*), it is advantageous when the clapper 66 has a leading projection 59. In this way, diversion of the clapper 66 is increased.

As described hereinabove, the running tracks do not necessarily have to run in a linear manner. Thus, clearly, curved running tracks are also possible. For example, the circular running tracks shown in FIGS. 30*a*) and 30*b*) can be used. The circular running tracks particularly preferably have six through bores 15, which are at the same distance apart in the circumferential direction, so that the running track describes a circle segment of 60° from one through hole to the next. The embodiment shown in FIG. 30*a*) additionally has a non-curved running track section that connects two through bores 15 lying one on top of the other, and thus represents the diameter of the circular path. The non-curved running track section additionally has a centrally arranged further through bore 15.

The circular running tracks described can also be assembled from different circle segment running tracks. Such circle segment running tracks are shown in FIGS. 31 and 32. Advantageously, these can have a semi-circular notch 15' on at least one end section, and a hollow half-cylinder 16' arranged substantially centrally thereto. In this way, these running tracks can, for example, be combined securely on the connecting elements. FIG. 31 shows a 60° circle segment running track 70 and FIG. 32 a 120° circle segment running track 71. For increasing variability, the running track 71 has a substantially centrally arranged bore 15. To reinforce the running tracks, tabs 69 are provided that connect the two parts of the running track separated by a continuous slot. Care must clearly be taken that the tabs 69 do not obstruct the rolling balls. The circular running tracks and respectively the circle segment running tracks can also have guides, as shown in FIGS. 30*b*) and 32*b*).

Figure 33B:
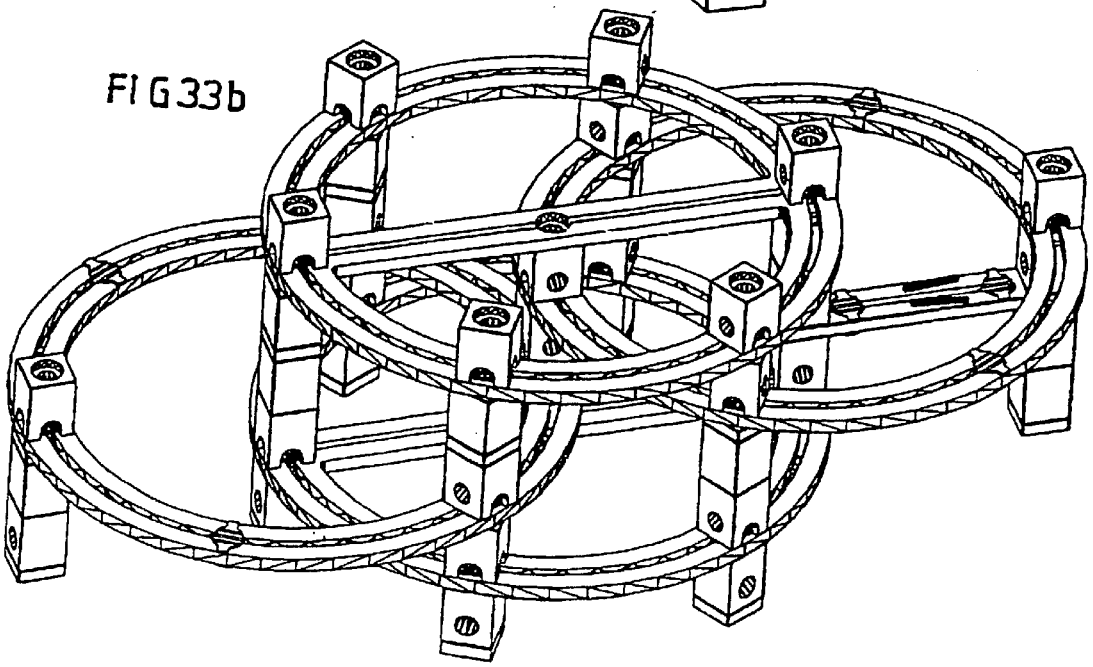

Circular constructions are possible with the aid of these running tracks, wherein as is shown for example in FIG. 33*b*), the circular paths in the individual planes can also be arranged offset laterally with respect to one another. Alternatively, or in combination with this, wave-shaped track courses can also be formed. By means of the additional curved running tracks, there are almost no limits to the imagination when forming the most varied layouts. Thus, for example, ball tracks can also be implemented whose layout represents one or more letters of the alphabet.

The radius of the circular running tracks 68 and respectively the radius of curvature of the circle segment running tracks 70, 71 advantageously corresponds to the effective length of at least some of the running tracks. The effective length of the running tracks is understood to be the distance between two, not necessarily adjacent, through bores 15 of the running tracks. A 60° circle segment running track then necessarily has the same effective length.

It is moreover also possible to couple two circle segment running tracks directly to one another so that the tracks overlap. The connecting element can be omitted as in general the height difference to be overcome is sufficient, due to the thickness of the tracks, to give the ball the necessary horizontal speed component. Particularly preferably, the circle segment running track thus has an indentation 72 that simplifies the crossing of the ball from one circle segment running track to the next. This is shown in FIGS. 34*a*) and 34*b*).

Figure 35B:
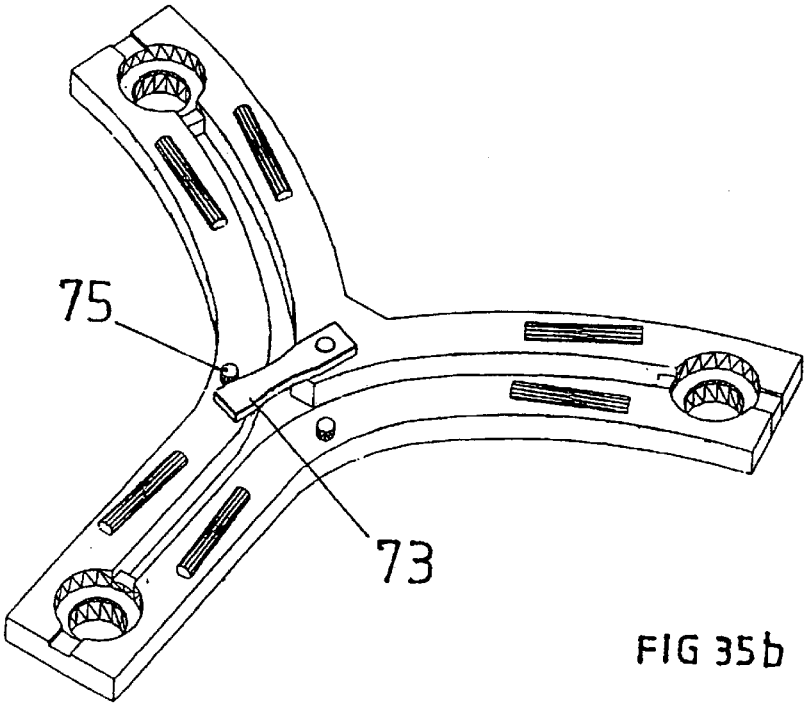

In FIGS. 35*a*) and 35*b*) respectively, a branching circle segment is shown. In both instances a diverting element 73 is arranged in approximately the centre of the Y-shaped running track, with the aid of which switching can be carried out back and forth between different ball paths. The distance apart of two through bores of the Y-shaped running tracks is here selected such that they can be installed as 60° circle segment running tracks into the ball path. This running track can, however be built into the ball path in principle at any point desired. By swinging over or respectively by diverting the diverting mechanism 73, the ball course is altered. In principle, this running track is also playable from all sides. In some instances, it can be necessary, however, that the returning ball actuates the diverting mechanism 73. In FIG. 35*b*), the diverting mechanism 73 is configured as a bar arranged in a pivoting manner. The bar is mounted by one side in a pivoting manner about a point of rotation. In addition, end stops 75 are provided that are to prevent overly wide diversion of the bar 73. The embodiment of the diverting element 73 in FIG. 35*a*) has a wedge 73 that is pivotable about the axle 74. The axle 74 is arranged in the plane of the tracks, so that the axle 74 runs substantially horizontally. Clearly, such branching cannot only be used in circle segment running tracks.

It is clearly evident that with the present ball track, there is practically no limit to the imagination. Constructions with any layout are possible. It is also left to the user as to whether a connecting element must follow a running track, and vice-versa, or whether running track is placed on running track, or respectively connecting element on connecting element. The variability obtained with the present invention ensures that children of all ages and in many cases even adults, will have pleasure using the ball track.

What is claimed is:

1. A ball track, comprising a plurality of individual component running tracks (1, 2, 3) and a plurality of individual component connecting elements (4, 5, 6, 7, 8, 9, 10, 11) that have a ball passage at an angle with respect to the horizontal, wherein the running tracks are single units, each running track being provided with a guide for rolling balls whether or not such running track is connected to another component and each running track being provided with at least one through aperture for transferring a ball onto another component, wherein the running tracks (1, 2, 3) and the connecting elements (4, 5, 6, 7, 8, 9, 10, 11) can be fitted into and onto one another in order to produce a variety of ball paths utilizing more than one component, wherein the ball path runs horizontally at least on a section of each of the running tracks.

2. The ball track according to claim 1, wherein the running tracks (1, 2, 3) and connecting elements (4, 5, 6, 7, 8, 9, 10, 11) can be connected together in a curved configuration about a substantially vertical axis.

3. The ball track according to claim 1 wherein the connecting elements are columns (4, 5, 6, 7, 8, 9, 10, 11) and the ball passages comprise vertical through bores (18).

4. The ball track according to claim 1, wherein at least one connecting element has a sound production means that is provided to produce a sound when a ball passes through the connecting element.

5. The ball track according to claim 4, wherein at least some of the connecting elements (4, 5, 6, 7, 8, 9, 10, 11) have at least one side exit aperture (19), and that at least one section (20) of the bore within the connecting element has an angle of inclination with respect to the horizontal of between 0° and 90°, so that a ball that falls into a vertical bore section (18) gains acceleration with a horizontal component when passing through the bore.

6. The ball track according to claim 5, wherein at least some of the connecting elements (4, 5, 6, 7, 8, 9, 10, 11) have two side exit apertures (19) that are formed by branching of the vertical bore section (18).

7. The ball track according to claim 6, wherein a centre point of the side exit apertures (19) is at a distance from the lower edge of the connecting element that is determined by the sum of the thickness of the running tracks and the radius of the side exit aperture.

8. A ball track according to claim 1, wherein at least some of the connecting elements (4, 5, 6, 7, 8, 9, 10, 11) have a horizontally running passageway (21) in a lower area.

9. A ball track according to claim 1, wherein some of the connecting elements (4, 5, 6, 7, 8, 9, 10, 11) have different effective heights that correspond to a whole number multiple of a pre-determined modular dimension.

10. A ball track according to claim 9, wherein the modular dimension is determined by the (vertical) thickness of the running tracks (1, 2, 3).

11. A ball track according to claim 1, wherein at least some of the tracks (1, 2, 3) have at least three through apertures (15).

12. A ball track according to claim 1, wherein at least some of the running tracks (1, 2, 3) have two apertures (15) close together on at least one end section.

13. A ball track according to claim 12, wherein tracks (1, 2, 3) have at least three through apertures (15).

14. A ball track according to claim 1, wherein some of the tracks have a through aperture (15) arranged approximately in the centre with respect to their length.

15. A ball track according to claim 14, wherein some of the tracks have two through apertures (15) arranged approximately in the centre with respect to their length.

16. A ball track according to claim 1, wherein ball guides in the tracks are formed by a continuous slot (14).

17. A ball track according to claim 1, wherein on the running tracks (1, 2, 3) and on the connecting elements (4, 5, 6, 7, 8, 9, 10, 11) projections and cut-outs are provided that engage alternately with one another when the running tracks and connecting elements are in an assembled state, so that the assembled tracks and connecting elements are protected from sideways relative movements.

18. A ball track according to claim 17, wherein the projections and cut-outs are arranged concentrically to the vertical through apertures (15, 18) and bores of track (1, 2, 3) and connecting element (4, 5, 6, 7, 8, 9, 10, 11).

19. A ball track according to claim 18, wherein the projections and cut-outs are configured annularly so that when assembled together, the tracks (1, 2, 3) and connecting elements (4, 5, 6, 7, 8, 9, 10, 11) can be rotated relative to one another about a common axis of a circle of projections and cut-outs.

20. A ball track according to claim 1, wherein the connecting elements (4, 5, 6, 7, 8, 9, 10, 11) have on an upper side an annular cut-out surrounding an upper aperture, and on an underside a cylindrical projection coaxial thereto, the outside diameter of which is smaller than or equal to the diameter of the upper aperture of the through apertures (15) of the tracks (1, 2, 3), wherein an outside diameter of the cylindrical projection corresponds with the inside diameter of the cut-out.

21. A ball track according to claim 17, wherein at least some of the running tracks (1, 2, 3) have annular projections arranged concentrically on an underside of some of the apertures, the outside diameter of which projection is equal to the inside diameter of a cut-out of a corresponding connecting element.

22. A ball track according to claim 1, wherein connecting plates (12, 13) are provided, which have one or more through bores (18), the size of which including any projections provided on the lower ends of the bore, corresponds to the dimensions of the apertures (15) of the running tracks (1, 2, 3).

23. A ball track according to claim 22, wherein the connecting plates (12, 13) have an effective height that corresponds to a whole number multiple of the (vertical) thickness of the running tracks (1, 2, 3).

24. A ball track according to claim 1, wherein at least one running track (3) is provided, which has horizontal end sections in different planes, which end sections have through apertures and are connected by means of an inclined roller track section, the length and incline of which is dimensioned such that the difference in level between the horizontal end sections corresponds to a whole number multiple of a modular dimension determined by the thickness of the running track.

25. A ball track according to claim 24, wherein on an upper side of a running track, at least one pair of guides (17) is fitted on either side of a running channel, which guides are further away from the channel at ends of the guides facing proximate through aperture (15) of the running tracks (1, 2, 3) than other ends of the guides.

26. A ball track according to claim 1, wherein at least one bridging element is provided that can be placed on a through aperture or bore in order to close it.

27. A ball track according to claim 26, wherein on at least one side, the bridging element has guide elements.

28. A ball track according to claim 26, wherein the bridging element is provided with at least one guide projection (31).

29. A ball track according to claim 1, wherein at least one sorting element is provided that has a through sorting aperture (32') that is smaller than the through apertures of the running tracks and connecting elements (32) so that smaller sized balls can pass through the sorting aperture while rolling elements or balls with larger dimensions are prevented from doing so.

30. A ball track according to claim 1, wherein a tipping element (33) is provided that can be freely positioned on the running tracks and connecting elements and that has a receiving means with a receiving position and a release position, wherein in the receiving position, the receiving means is able a receive at least one rolling element, and in the release position is able to release at least one rolling element.

31. A ball track according to claim 30, wherein the receiving means assumes a stable balance in the receiving position that is made unstable by receiving one or more balls, so that the receiving means transfers into the release position.

32. A ball track according to claim 30, wherein the tipping element has two receiving means, wherein in a first state of the tipping element, the first receiving means is in the receiving position, and the second in the release position, and in a second state of the tipping element (33) the first receiving means is in the release position and the second receiving means in the receiving position.

33. A ball track according to claim 1, wherein a spiral element (35) is provided that serves to receive balls, that are guided through the spiral element (35) on a spiral shaped path, that preferably runs conically.

34. A ball track according to claim 33, wherein the height of the cone circumscribed by the spiral shaped path is a whole number multiple of the modular dimension.

35. A ball track according to claim 33, wherein the spiral element (35) can adopt at least tow position, where in a storage position the spiral path has substantially no vertical components, and in a playing position the spiral path runs conically.

36. A ball track according to claim 35, wherein the spiral element has two or more playing positions that differ depending upon different heights of the cone circumscribed by the spiral path.

37. A ball track according to claim 33, wherein the balls gain acceleration on the spiral path through the spiral element (35) and have a radially inward directed force component that is exerted on the ball by means of a guide defining the outside of the spiral path of movement of the ball.

38. A ball track according to claim 33, wherein the spiral element (55) has a substantially horizontal, straight running track section, and a spiral section.

39. A ball track according to claim 33, wherein the spiral element (55) is playable from both sides.

40. A ball track according to claim 1, wherein a blocking element (54, 66, 67) is provided that at least sometimes blocks the ball path.

41. A ball track according to claim 40, wherein the blocking element (54, 66, 67) has a trigger means (66, 67) which, when it is actuated, permits the ball to overcome the blocking element.

42. A ball track according to claim 41, wherein the blocking element is provided with a body (54) and a trigger means (66, 67) arranged movably inside it.

43. A ball track according to claim 42, wherein the trigger means (66, 67) is configured such that it can be triggered by a ball rolling on an adjacent running track.

44. A ball track according to claim 43, wherein the trigger means is composed of a clapper (58), a pivotable suspension (57) and a saddle (60).

45. A ball track according to claim 44, wherein the saddle (60) has a cavity (61).

46. A ball track according to claim 44, wherein the body (54) has an upper inlet aperture (18) and a side exit aperture (19).

47. A ball track according to claim 46, wherein in lateral cross-section, the saddle is substantially in the shape of a rectangle, wherein an upper surface of the saddle is concavely curved, and the height $d_2$ of a rectangle on a side of the saddle facing an exit aperture is greater than the height $d_1$ of the rectangle on the side of the saddle facing away from the exit aperture.

48. A ball track according to claim 1, wherein at least one running track has a section curved about a vertically running axis.

49. A ball track according to claim 48, wherein at least one running track (68) describes a circle.

50. A ball track according to claim 48, wherein at least one running track (70, 71) describes a segment of a circle.

51. A ball track according to claim 50, wherein at least one running track (70, 71) describes a 60° or a 120° circle segment.

52. A ball track according to claim 50, wherein at least one circle segment running track (70, 71) has, on at least one end section, a substantially semi-circular aperture (15') that is preferably surrounded by a hollow half-cylinder (16') concentric thereto.

53. A ball track according to claim 50, wherein the curved running tracks are provided with through apertures that preferably are at a distance apart along the path of the circle that is approximately $0.333 \times \pi \times r$, wherein r is the radius of curvature of the running tracks, and $\pi$ represents the number pi.

54. A ball track according to claim 53, wherein the radius of curvature r corresponds to the effective length of at least one running track, wherein the effective length corresponds to the distance between two, not necessarily adjacent, through apertures (15) arranged on the running track.

55. A ball track according to claim 1, wherein at least one running track is branched.

56. A ball track according to claim 55, wherein at least one branched running track has a diverting element 73 by means of which it can be determined along which ball path a ball travels.

* * * * *

UNITED STATES PATENT AND TRADEMARK OFFICE

CERTIFICATE OF CORRECTION

PATENT NO. : 6,536,763 B1
DATED : March 25, 2003
INVENTOR(S) : Wilfried Braun

It is certified that error appears in the above-identified patent and that said Letters Patent is hereby corrected as shown below:

Title page,
Item [22], PCT Filed: "Dec. 22, 2000," should read -- Dec. 22, 1999 --

Signed and Sealed this

Twenty-sixth Day of August, 2003

JAMES E. ROGAN
*Director of the United States Patent and Trademark Office*